US011726426B2

(12) United States Patent
Fujinaka

(10) Patent No.: US 11,726,426 B2
(45) Date of Patent: Aug. 15, 2023

(54) IMAGE FORMING APPARATUS

(71) Applicant: CANON KABUSHIKI KAISHA, Tokyo (JP)

(72) Inventor: Koji Fujinaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/748,978

(22) Filed: May 19, 2022

(65) Prior Publication Data

US 2022/0276587 A1 Sep. 1, 2022

Related U.S. Application Data

(63) Continuation of application No. PCT/JP2020/043552, filed on Nov. 24, 2020.

(30) Foreign Application Priority Data

Nov. 28, 2019 (JP) ..... JP2019-215829

(51) Int. Cl.
*G03G 21/16* (2006.01)
*G03G 15/01* (2006.01)
*G03G 15/08* (2006.01)

(52) U.S. Cl.
CPC ..... *G03G 21/1619* (2013.01); *G03G 15/0121* (2013.01); *G03G 15/0822* (2013.01); *G03G 15/0865* (2013.01); *G03G 21/1633* (2013.01); *G03G 15/0894* (2013.01); *G03G 2215/066* (2013.01); *G03G 2215/0872* (2013.01)

(58) Field of Classification Search
CPC ..... G03G 15/0121; G03G 15/0822; G03G 15/0865; G03G 15/0894; G03G 21/1619; G03G 21/1633; G03G 21/1814; G03G 2215/066; G03G 2215/0872
See application file for complete search history.

(56) References Cited

U.S. PATENT DOCUMENTS 11,506,991 B2 * 11/2022 Choi ..... G03G 15/0867
2005/0276631 A1 * 12/2005 Mori ..... G03G 21/181 399/111
2008/0317481 A1 * 12/2008 Nagano ..... G03G 15/0875 399/258
2021/0103235 A1 * 4/2021 Oshima ..... G03G 15/0877

FOREIGN PATENT DOCUMENTS

JP H04-32854 A 2/1992
JP 2001-175044 A 6/2001
JP 2005-077520 A 3/2005
JP 2005-242213 A 9/2005

* cited by examiner

*Primary Examiner* — Joseph S Wong
(74) *Attorney, Agent, or Firm* — Canon U.S.A., Inc. I.P. Division

(57) ABSTRACT

The process unit is configured to be rotatable relative to the frame about a rotation axis extending in a rotation axis direction of the photosensitive drum between a first position at which the photosensitive drum comes into contact with the transfer member and forms the transfer nip portion and a second position at which the photosensitive drum is separated from the transfer member, and a direction in which the process unit rotates from the first position to the second position is a direction in which the replenishing port of the process unit moves away when the process unit is viewed from the front surface side.

9 Claims, 18 Drawing Sheets

IMAGE FORMING APPARATUS

CROSS-REFERENCE TO RELATED APPLICATIONS

This application is a Continuation of International Patent Application No. PCT/JP2020/043552, filed Nov. 24, 2020, which claims the benefit of Japanese Patent Application No. 2019-215829, filed Nov. 28, 2019, both of which are hereby incorporated by reference herein in their entirety.

BACKGROUND OF THE INVENTION

Field of the Invention

The present invention relates to an image forming apparatus that forms an image on a recording material.

Background Art

An image forming apparatus of a toner replenishing type is known as an electrophotographic image forming apparatus. The image forming apparatus of the toner replenishing type includes an apparatus main body to and from which a toner container that stores toner can be attached and detached in a state in which a developing container that includes a photosensitive drum and a developing roller is in the apparatus main body. The apparatus has an advantage of being able to continue image formation by replacing only the toner container in a case where the apparatus runs out of toner.

On the other hand, as discussed in Japanese Patent Application Laid-Open No. 2005-77520, a configuration is widely used in which a process unit needs to be taken out to access a sheet jammed inside an apparatus main body of an image forming apparatus.

CITATION LIST

Patent Literature

PTL 1: Japanese Patent Application Laid-Open No. 2005-77520

SUMMARY OF THE INVENTION

According to an aspect of the present invention, an image forming apparatus to and from which a toner container containing toner can be attached and detached, the image forming apparatus being configured to form a toner image on a recording material, includes a process unit including a photosensitive drum configured to carry a toner image, a developing roller configured to supply toner to the photosensitive drum, and a toner storage unit configured to store the toner to be carried by the developing roller, the toner storage unit being provided with a replenishing port through which the toner is replenished into the toner storage unit, a transfer member configured to come into contact with the photosensitive drum and form a transfer nip portion, for transferring the toner image on the photosensitive drum to the recording material, together with the photosensitive drum, a conveyance path through which the recording material conveyed by the transfer nip portion passes, an operation unit configured to operate the image forming apparatus, a frame configured to support the process unit, the frame including an opening portion for accessing the conveyance path from a front surface side being a side facing a display surface of the operation unit, and an opening and closing member configured to be movable between a closed position at which the opening portion is covered by the opening and closing member and an open position at which the opening portion is opened by the opening and closing member, wherein the image forming apparatus is configured so that the toner container can be attached to the replenishing port in a state in which at least part of the toner container is located on an outside of the image forming apparatus and the toner storage unit can be replenished with the toner through the replenishing port, wherein the process unit is configured to be rotatable relative to the frame about a rotation axis extending in a rotation axis direction of the photosensitive drum between a first position at which the photosensitive drum comes into contact with the transfer member and forms the transfer nip portion and a second position at which the photosensitive drum is separated from the transfer member, and wherein a direction in which the process unit rotates from the first position to the second position is a direction in which the replenishing port moves away when the process unit is viewed from the front surface side.

Further features of the present invention will become apparent from the following description of exemplary embodiments with reference to the attached drawings.

DESCRIPTION OF THE EMBODIMENTS

First Exemplary Embodiment

An image forming apparatus 1 according to a first exemplary embodiment is a monochrome printer using an electrophotographic method that forms an image on a recording material based on image information input from an external device. A configuration of the image forming apparatus 1 is described with reference to the attached drawings. [Overall Configuration]

Figure 1A:
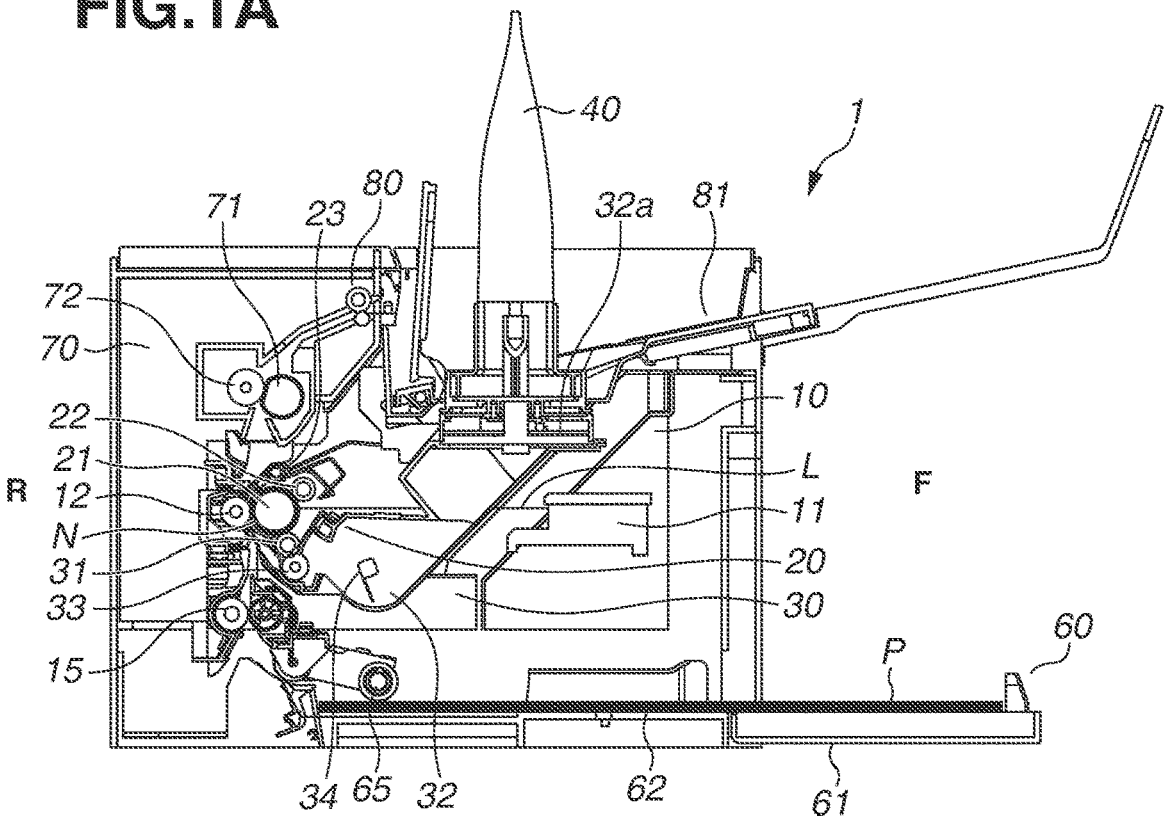
FIG. 1A is a schematic cross-sectional view of an image forming apparatus according to a first exemplary embodiment.
Figure 1B:
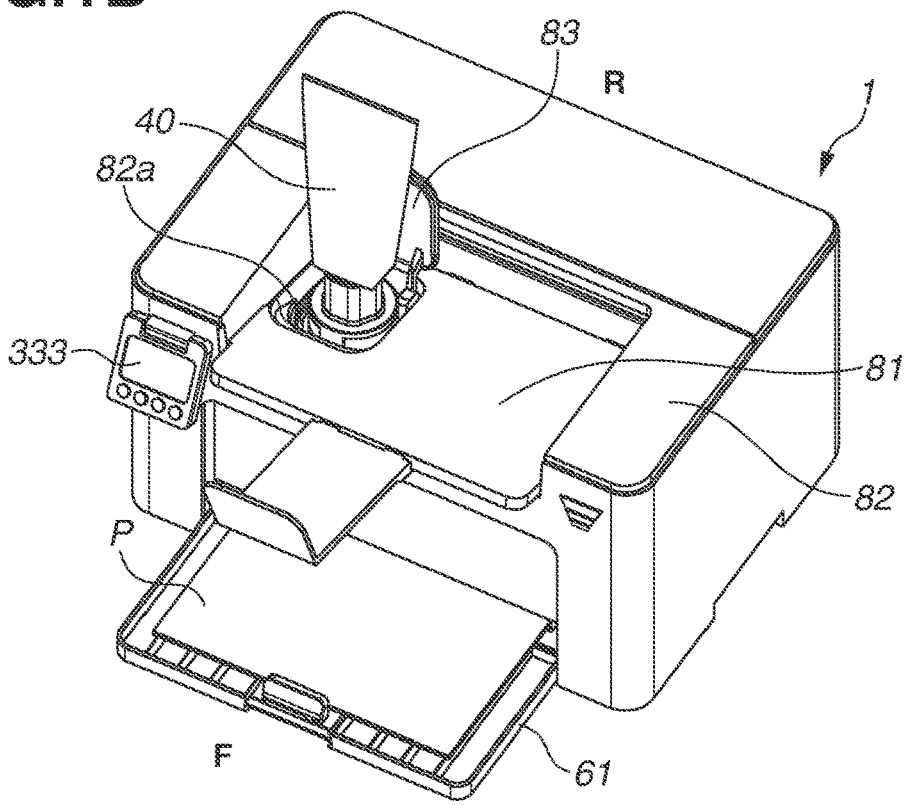
FIG. 1B is a perspective view of the image forming apparatus according to the first exemplary embodiment.
Figure 2A:
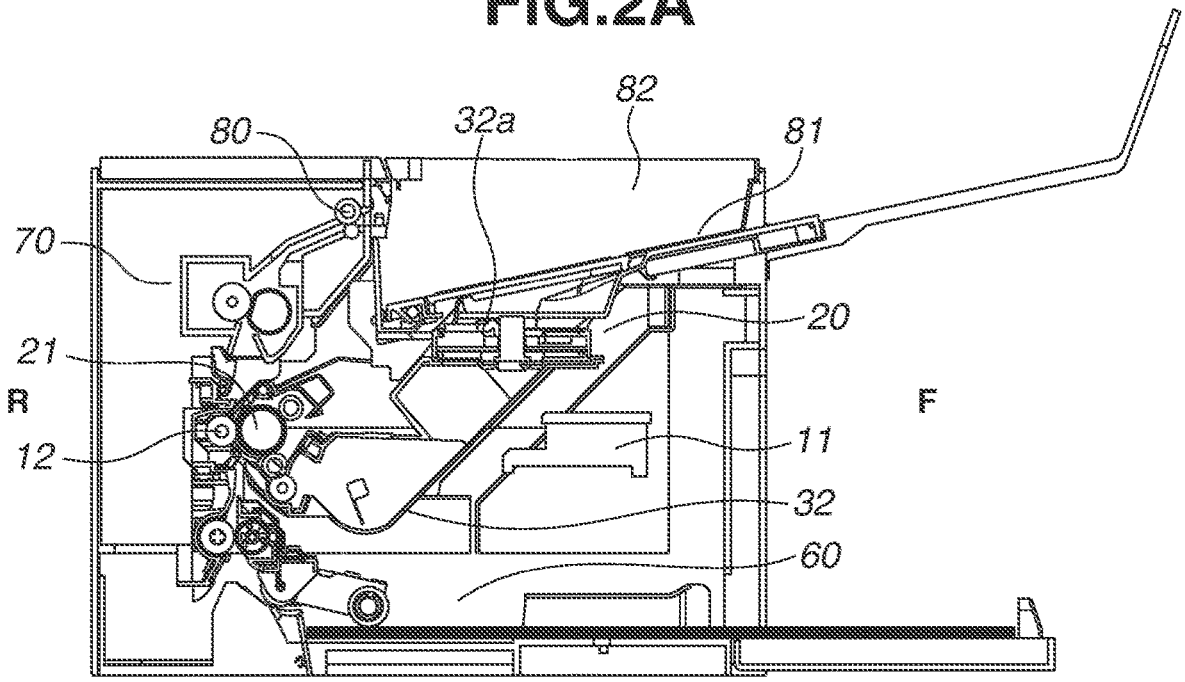
FIG. 2A is a schematic cross-sectional view of the image forming apparatus according to the first exemplary embodiment.
Figure 2B:
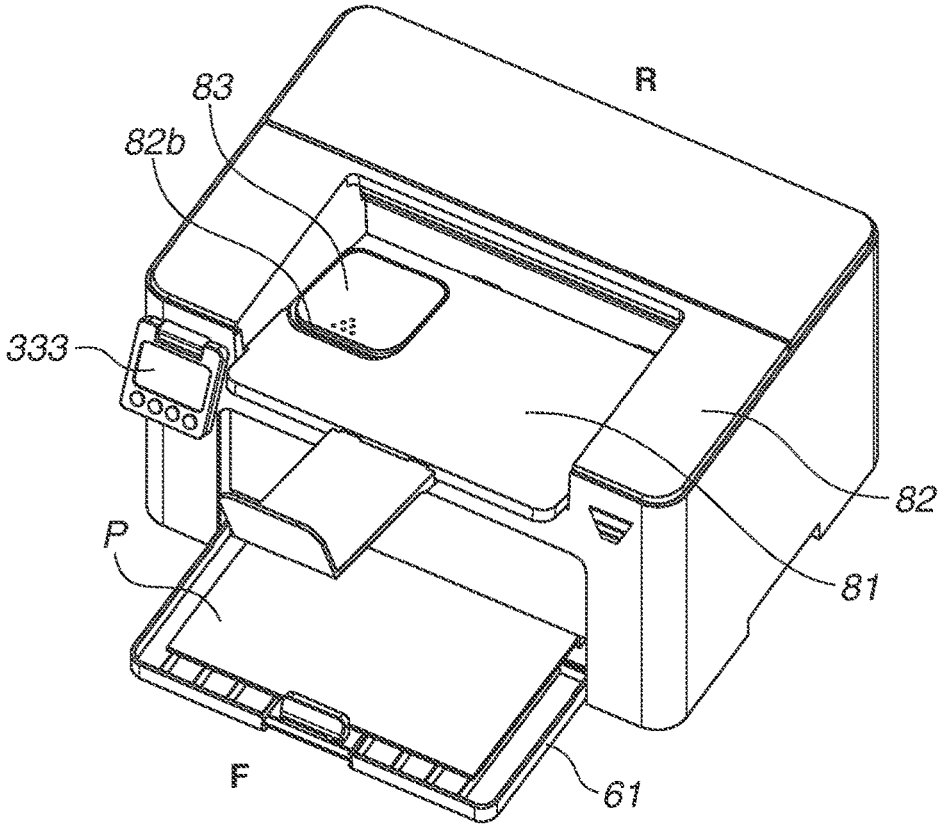
FIG. 2B is a perspective view of the image forming apparatus according to the first exemplary embodiment.
Figure 3A:
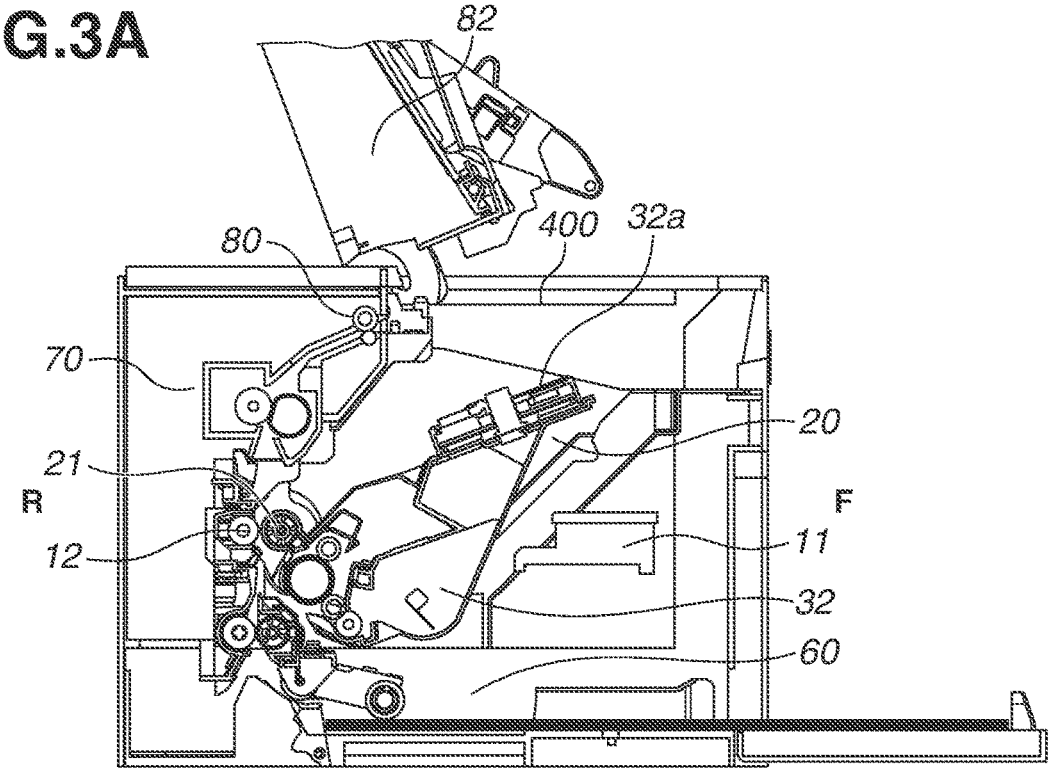
FIG. 3A is a schematic cross-sectional view of the image forming apparatus according to the first exemplary embodiment.
Figure 3B:
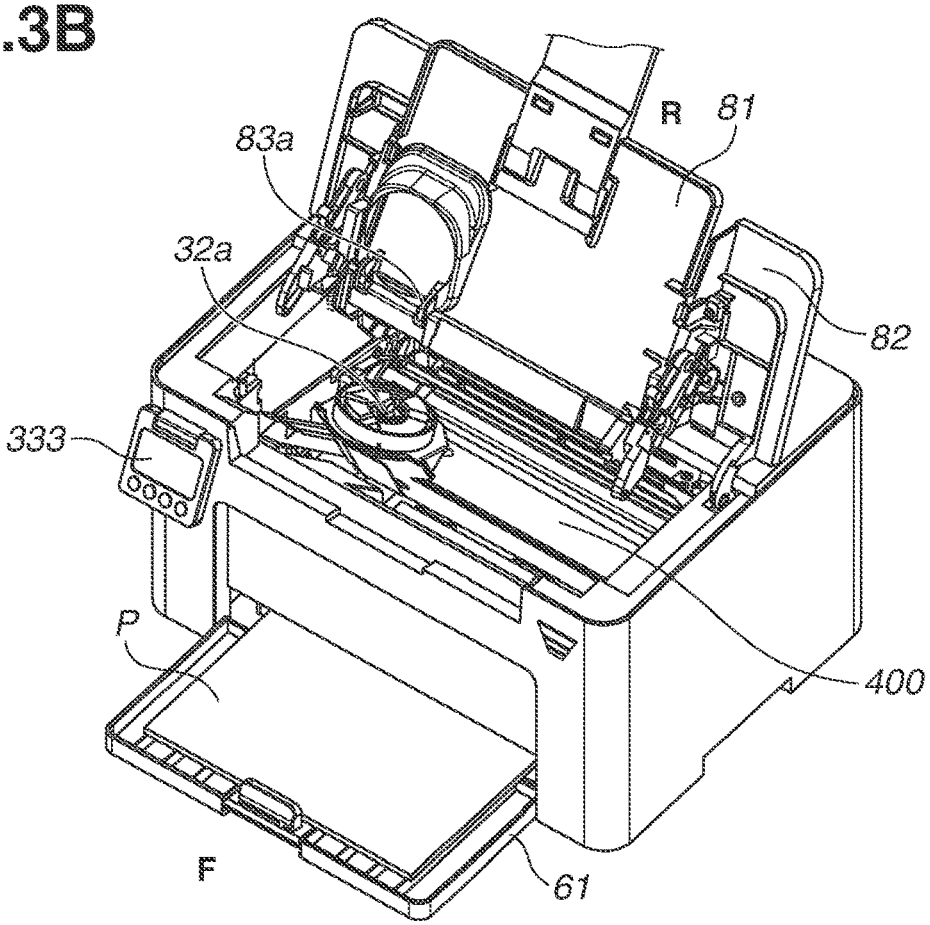
FIG. 3B is a perspective view of the image forming apparatus according to the first exemplary embodiment.

FIGS. 1A and 1B are respectively a schematic cross-sectional view and a perspective view of the image forming apparatus 1 to which a toner pack 40 is attached according to the first exemplary embodiment. FIGS. 2A and 2B are respectively a schematic cross-sectional view and a perspective view of the image forming apparatus 1 to which the toner pack 40 is not attached. FIGS. 3A and 3B are respectively a schematic cross-sectional view and a perspective view of the image forming apparatus 1 in a state in which a top cover 82 is opened.

As illustrated in FIGS. 1A and 1B, the image forming apparatus 1 includes an image forming unit 10 that forms a toner image on a recording material, a feed unit 60 that feeds the recording material to the image forming unit 10, a fixing unit 70 that fixes the toner image to the recording material, and a discharge roller pair 80.

The image forming unit 10 includes a scanner unit 11, a process unit 20, and a transfer roller 12 that transfers the toner image formed on a photosensitive drum 21 of the process unit 20 to the recording material. The process unit 20 includes the photosensitive drum 21, a charging roller 22 arranged in a periphery of the photosensitive drum 21, and a developing device 30 that includes a pre-exposure device 23 and a developing roller 31.

The photosensitive drum 21 is a photosensitive member formed into a cylindrical shape. The photosensitive drum 21 according to the present exemplary embodiment has a photosensitive layer formed of a negatively charged organic photoreceptor on a drum shaped base substance molded from aluminum. Further, the photosensitive drum 21 as an image bearing member is rotationally driven by a motor in a predetermined direction (a clockwise direction in the drawing) at a predetermined process speed.

The charging roller 22 comes into contact with the photosensitive drum 21 with a predetermined press contact force and forms a charging portion. A charging high voltage power source applies a desired charging voltage to the charging roller 22, and thus a surface of the photosensitive drum 21 is uniformly charged to a predetermined potential. In the present exemplary embodiment, the photosensitive drum 21 is charged to negative polarity by the charging roller 22. The pre-exposure device 23 eliminates a surface potential of the photosensitive drum 21 before the surface thereof enters the charging portion to stably generate discharge in the charging portion.

The scanner unit 11 scans and exposes the surface of the photosensitive drum 21 to a laser beam by irradiating the photosensitive drum 21 with the laser beam corresponding to image information input from the external device, using a polygon mirror. An electrostatic latent image corresponding to the image information is formed on the surface of the photosensitive drum 21 by the exposure. The scanner unit 11 is not limited to a laser scanner device, and, for example, a light emitting diode (LED) exposure device including an LED array in which a plurality of LEDs is arranged in a longitudinal direction of the photosensitive drum 21 may be adopted.

The developing device 30 includes the developing roller 31 as a developer carrying member that carries developer, a developing container 32 serving as a frame of the developing device 30, and a supply roller 33 that can supply toner to the developing roller 31. The developing roller 31 and the supply roller 33 are rotatably supported by the developing container 32. The developing roller 31 is placed in an opening portion of the developing container 32 to face the photosensitive drum 21. The supply roller 33 is rotatably brought into contact with the developing roller 31 and applies the toner stored in the developing container 32 to a surface of the developing roller 31.

The developing device 30 uses a contact developing method as a developing method. In other words, a toner layer carried by the developing roller 31 comes into contact with the photosensitive drum 21 in a developing portion (developing area) in which the photosensitive drum 21 faces the developing roller 31. A developing high voltage power source applies a developing voltage to the developing roller 31. The toner carried by the developing roller 31 is transferred from the developing roller 31 to the drum surface based on potential distribution on the surface of the photosensitive drum 21 under the developing voltage, and thus the electrostatic latent image is developed into the toner image.

The developing container 32 is provided with a stirring member 34 as a stirring unit inside thereof. The stirring member 34 is driven by a not-illustrated motor and rotates to stir the toner in the developing container 32 and to feed the toner to the developing roller 31 and the supply roller 33. The stirring member 34 also has a role in circulating the toner that is not used for development and stripped from the developing roller 31 in the developing container 32 and making the toner in the developing container 32 uniform.

The feed unit 60 includes a front door 61 openably and closably supported by the image forming apparatus 1, a stacking tray 62, and a pickup roller 65. The stacking tray 62 forms a bottom surface of a recording material storage space that appears in a case where the front door 61 is opened. The front door 61 closes the recording material storage space in a state of being closed with respect to the image forming apparatus 1 and supports a recording material P together with the stacking tray 62 and an intermediate plate 63 in a state of being opened with respect to the image forming apparatus 1.

The fixing unit 70 uses a thermal fixing method in which image fixing processing is performed by heating and melting the toner on the recording material. The fixing unit 70 includes a fixing film 71, a fixing heater such as a ceramic heater that heats the fixing film 71, a thermistor that measures a temperature of the fixing heater, and a pressure roller 72 that is brought into pressure contact with the fixing film 71.

As illustrated in FIG. 1B, an operation unit (an operation panel) 333 is provided on an upper part of the image forming apparatus 1. A side on which the operation unit 333 is provided is referred to as a front surface F of the image forming apparatus 1, and an opposite side of the front surface F is referred to as a rear surface R.

Next, an image forming operation of the image forming apparatus 1 is described. In a case where a command to form an image is input to the image forming apparatus 1, the image forming unit 10 starts an image forming process based on image information input from an external computer connected to the image forming apparatus 1. The scanner unit 11 irradiates the photosensitive drum 21 with the laser beam based on the input image information. At that time, the photosensitive drum 21 has been charged by the charging roller 22 in advance, and by the photosensitive drum 21 being irradiated with the laser beam, an electrostatic latent image is formed on the photosensitive drum 21. Subsequently, the electrostatic latent image is developed by the developing roller 31, and the toner image is formed on the photosensitive drum 21.

In parallel with the above-described image forming process, the pickup roller 65 in the feed unit 60 feeds the recording material P supported by the front door 61 and the stacking tray 62. The recording material P is fed to a registration roller 15 by the pickup roller 65 and is conveyed to a transfer nip formed by the transfer roller 12 and the photosensitive drum 21 in synchronization with transfer timing of the toner image.

A transfer high voltage power source applies a transfer voltage to the transfer roller 12 as a transfer member, and the toner image carried by the photosensitive drum 21 is transferred to the recording material P conveyed by the registration roller 15. The recording material P to which the toner image is transferred is conveyed to the fixing unit 70, and the toner image is heated and pressed when passing through a nip portion between the fixing film 71 and the pressure roller 72 in the fixing unit 70. Accordingly, toner particles are melted and then fixed, so that the toner image is fixed to the recording material P. The recording material P that has passed through the fixing unit 70 is discharged to the outside of the image forming apparatus 1 by the discharge roller pair 80 and is stacked on a discharge tray 81 formed on the upper part of the image forming apparatus 1.

As illustrated in FIGS. 3A and 3B, an opening portion 400 that opens upward is formed on the upper part of the image forming apparatus 1, and the opening portion 400 is covered with the top cover 82 (an opening and closing member). The top cover 82 is supported to be openable and closable with respect to the image forming apparatus 1 about a rotation shaft 83*a* extending in a right-and-left direction, and the discharge tray 81 (a stacking unit) is formed on an upper surface of the top cover 82. The top cover 82 is opened from a side of the front surface F toward a side of the rear surface R.

A toner replenishing method is described.

Figure 4:
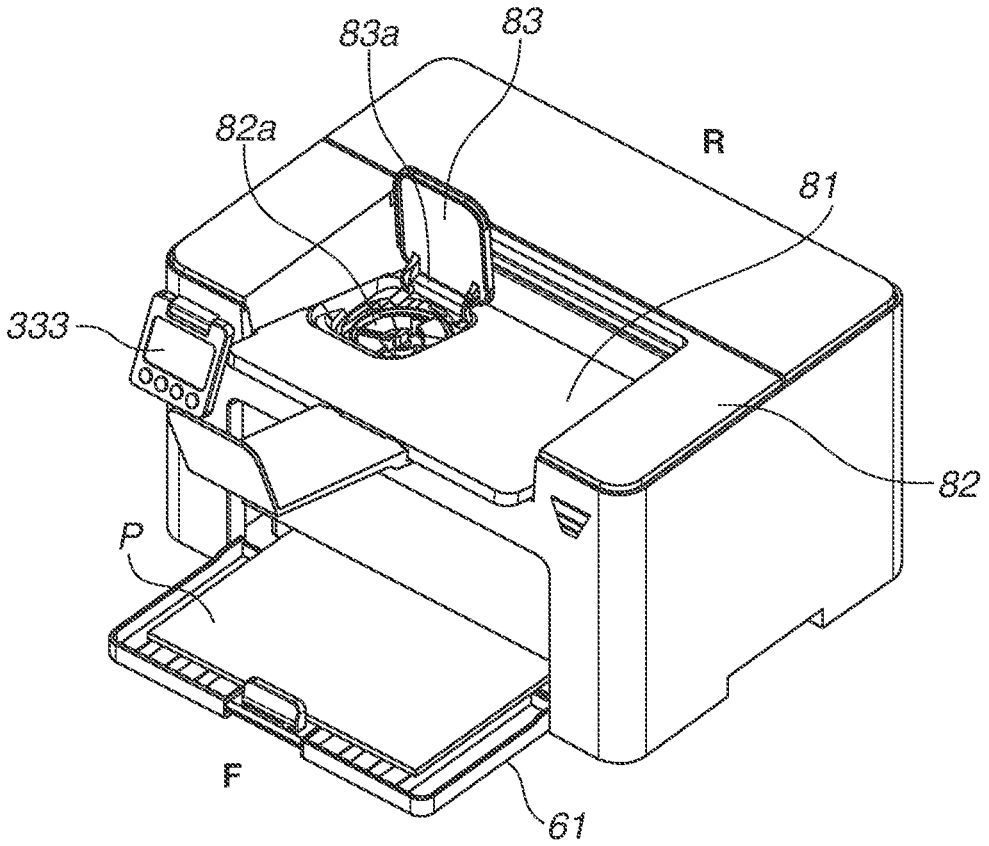
FIG. 4 is a perspective view of the image forming apparatus according to the first exemplary embodiment.

As illustrated in FIG. 4, the top cover 82 includes an opening portion 82*a* and an opening and closing member 83 provided to rotate about the rotation shaft 83*a* to a position where the opening portion 82*a* is covered and to a position where the opening portion 82*a* is exposed. The opening and closing member 83 and the opening portion 82*a* are provided to an end portion of the discharge tray 81 on a side where the operation unit 333 is located in a direction orthogonal to a direction from the front surface F toward the rear surface R of the discharge tray 81. The opening and closing member 83 is opened in the direction from the front surface F toward the rear surface R by hooking a finger on a recessed portion 82*b* provided on the top cover 82 illustrated in FIG. 2B.

Figure 7:
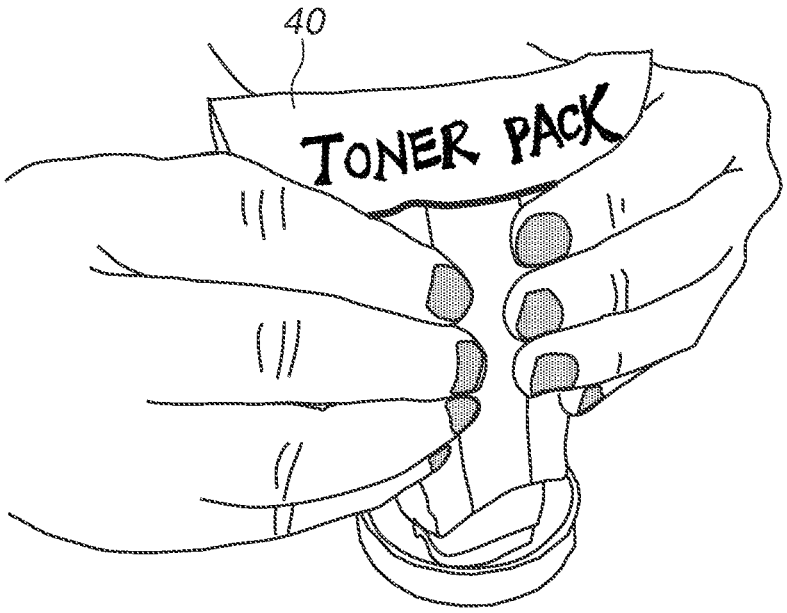
FIG. 7 illustrates how a user squeezes the toner pack according to the first exemplary embodiment.

The opening and closing member 83 is opened, and thus a replenishing port 32*a* for toner replenishment that is formed on an upper surface of the developing container 32 is exposed from the opening portion 82*a* of the discharge tray 81. A user can access the replenishing port 32*a* without opening the top cover 82. The user attaches the toner pack 40 as a toner container filled with replenishment toner to the replenishing port 32*a* in a state in which the process unit 20 is in the image forming apparatus 1. Then, as illustrated in FIG. 7, the user squeezes the toner pack 40 attached to the replenishing port 32*a* with fingers to replenish the developing device 30 with the toner. As described above, an operation to remove the process unit 20 to the outside of the image forming apparatus 1 is not necessary to replenish the developing container 32 with the toner, and the user can access the replenishing port 32*a* by simply opening the opening and closing member 83, so that usability can be improved.

[Collection of Transfer Residual Toner]

The image forming apparatus 1 according to the present exemplary embodiment adopts a cleaner-less configuration in which transfer residual toner remaining on the photosensitive drum 21 without being transferred to the recording material P is collected in the developing device 30 and reused. The transfer residual toner is removed by the following processes. The transfer residual toner is a mixture of toner charged to positive polarity and toner that is charged to the negative polarity but does not have sufficient charge. The charge of the photosensitive drum 21 after transfer is removed by the pre-exposure device 23, and a uniform discharge is caused by the charging roller 22 so that the transfer residual toner is charged to the negative polarity again. The transfer residual toner that is charged to the negative polarity again in the charging portion reaches the developing portion as the photosensitive drum 21 rotates. Then, a surface area of the photosensitive drum 21 that has passed through the charging portion is exposed to light by the scanner unit 11 in a state in which the transfer residual toner adheres to the surface, and the electrostatic latent image is written thereon.

Behavior of the transfer residual toner that has reached the developing portion is described separately for an exposure portion and a non-exposure portion of the photosensitive drum 21. The transfer residual toner adhering to the non-exposure portion of the photosensitive drum 21 is transferred to the developing roller 31 at the developing portion due to a potential difference between a potential (a dark portion potential) of the non-exposure portion of the photosensitive drum 21 and the developing voltage and is collected in the developing container 32. This is because the developing voltage to be applied to the developing roller 31 has the positive polarity relative to the potential of the non-exposure portion on the assumption that normal charging polarity of the toner is the negative polarity. The toner collected in the developing container 32 is stirred and dispersed by the stirring member 34 in the toner in the developing container 32 and is used again in a developing process by being carried by the developing roller 31.

Meanwhile, the transfer residual toner adhering to the exposure portion of the photosensitive drum 21 remains on the drum surface without being transferred from the photosensitive drum 21 to the developing roller 31 in the developing portion. This is because the developing voltage to be applied to the developing roller 31 has the potential even more negative than that of the exposure portion (light portion potential) on the assumption that the normal charging polarity of the toner is the negative polarity. The transfer residual toner remaining on the drum surface is carried by the photosensitive drum 21 together with other toner to be transferred from the developing roller 31 to the exposure portion, moves to a transfer portion, and is transferred to the recording material P in the transfer portion.

As described above, in the present exemplary embodiment, the cleaner-less configuration is employed that collects the transfer residual toner in the developing device 30 and reuses the transfer residual toner, but a conventionally known configuration may be employed that collects the transfer residual toner using a cleaning blade abutting on the photosensitive drum 21. In this case, the transfer residual toner collected by the cleaning blade is collected in a collection container that is installed separately from the developing device 30. However, the cleaner-less configuration can eliminate the need for a transfer residual toner collection container, eliminate the need for taking out the process unit 20 from the image forming apparatus 1 to discard the toner in the collection container, and thus improve the usability. Further, an installation space of the collection container is not necessary, so that the image forming apparatus 1 can be further downsized, and a printing cost can be reduced by reusing the transfer residual toner.

[Configurations of Developing Container and Toner Pack]

Figure 5A:
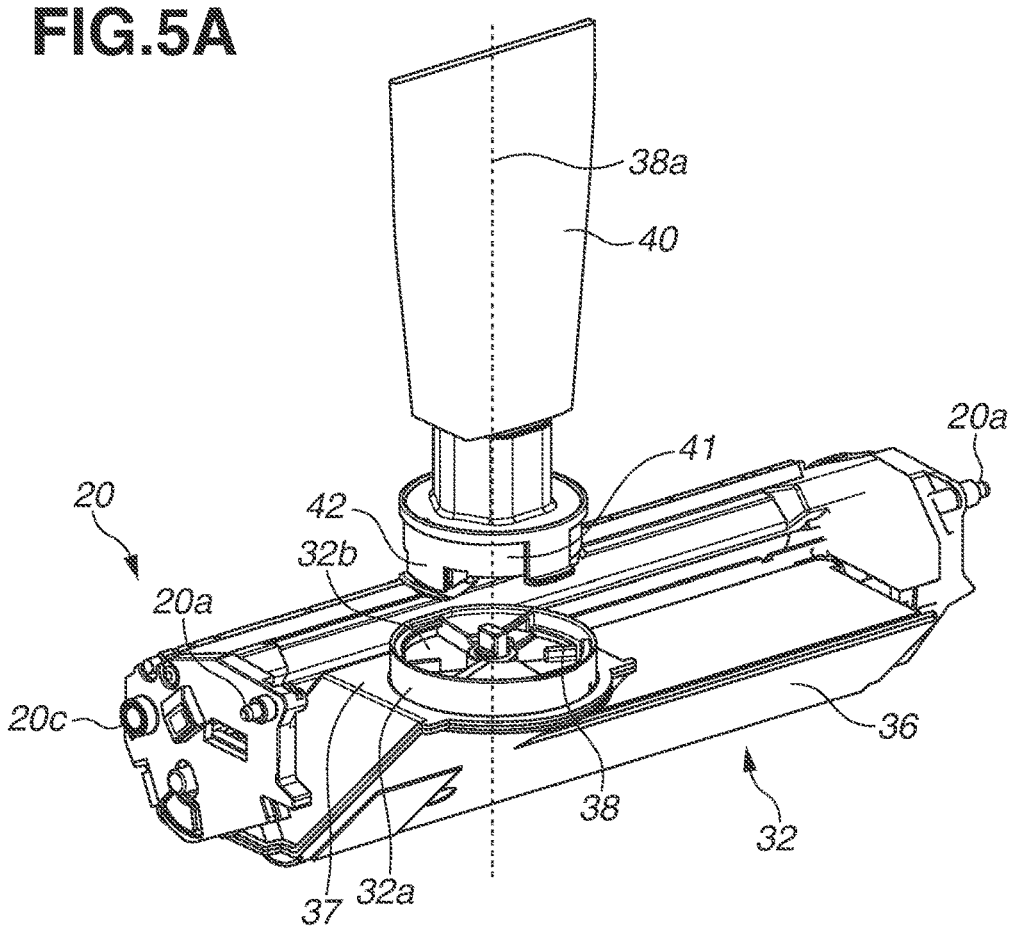
FIG. 5A is a perspective view of a process unit and a toner pack according to the first exemplary embodiment.
Figure 5B:
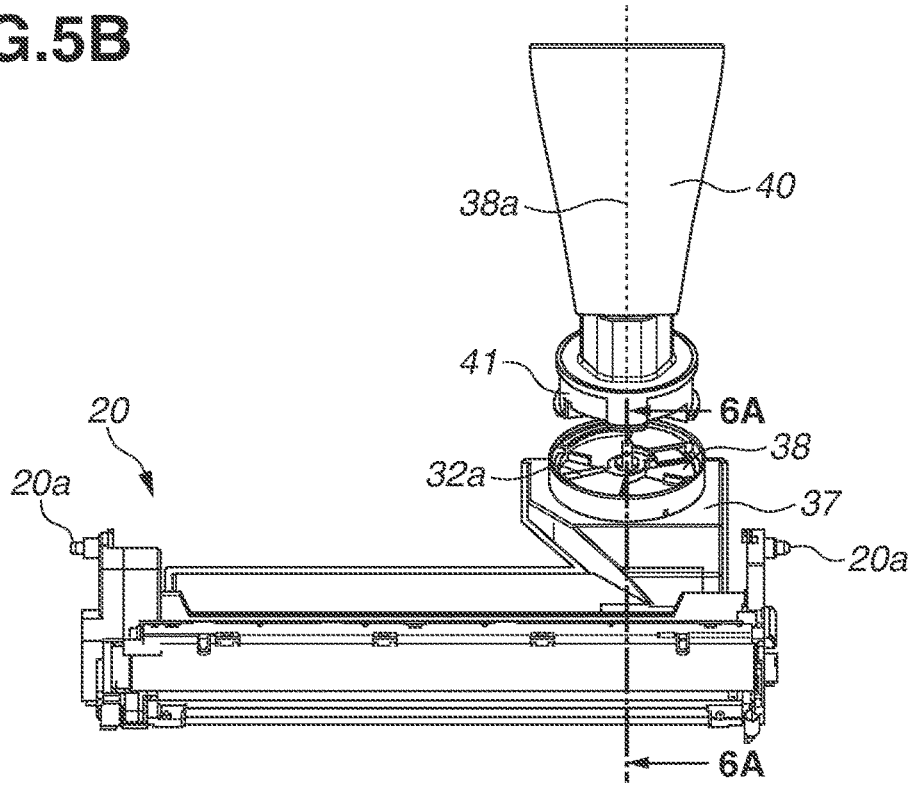
FIG. 5B is a rear view of the process unit and the toner pack according to the first exemplary embodiment.
Figure 6:
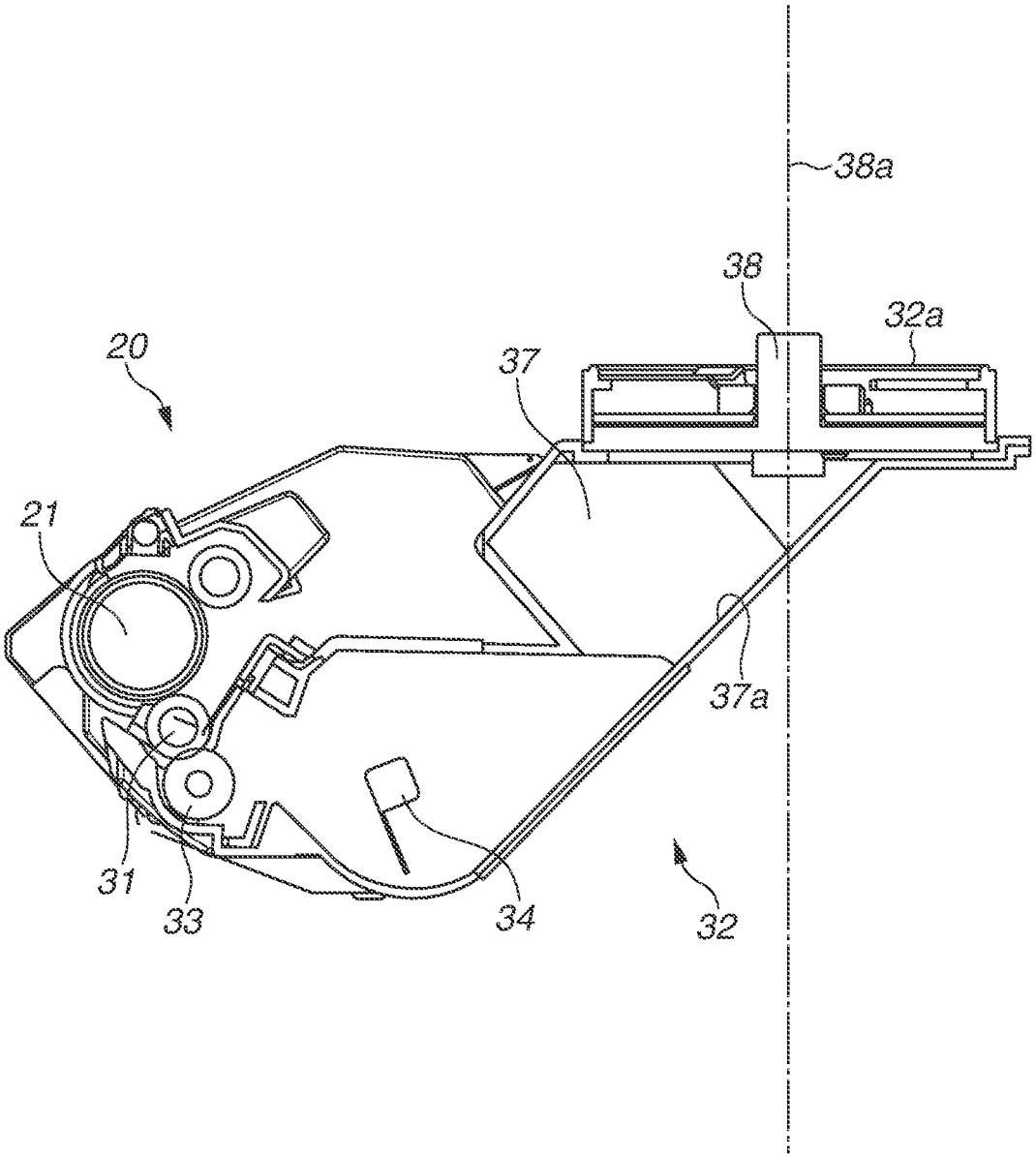
FIG. 6 is a schematic cross-sectional view of the process unit according to the first exemplary embodiment.

Next, configurations of the developing container 32 and the toner pack 40 are described. FIG. 5A is a perspective view of the developing container 32 and the toner pack 40, and FIG. 5B illustrates the developing container 32 and the toner pack 40 viewed from a side of the rear surface R. FIG. 6 is a cross-sectional view taken along a line 6A-6A in FIG. 5B.

As illustrated in FIGS. 5A, 5B, and 6, the developing container 32 includes a storage chamber 36 (a toner storage unit) that stores the toner and the stirring member 34. The storage chamber 36 extends over an entire length of the developing container 32 in the longitudinal direction (in a rotation axis direction of the developing roller 31). The developing container 32 has a protruding portion 37 protruding upward relative to a center portion thereof at one end portion in the longitudinal direction of the storage chamber 36. In the present exemplary embodiment, the protruding portion 37 is formed on a left side (the side of the operation unit 333) of the developing container 32 when the developing container 32 is viewed from the front surface F of the image forming apparatus 1. The operation unit 333 includes a display unit for notifying a user of information. The front surface F of the image forming apparatus 1 described here is the side on which the operation unit 333 is provided and is also the side facing a display surface of the operation unit 333. Further, the front surface F of the image forming apparatus 1 is on an upstream side in a direction in which the recording material P on the stacking tray 62 is conveyed by the pickup roller 65.

The protruding portion 37 communicates with the storage chamber 36 in the developing container 32 and extends from the storage chamber 36 toward the front surface F and obliquely upward. Thus, the replenishing port 32*a* formed in the protruding portion 37 is arranged on an upper part on a side of the front surface F of the image forming apparatus 1, and the replenishing port 32*a* of the developing container 32 can easily be accessed.

A void through which a laser L (refer to FIG. 1A) emitted from the scanner unit 11 (refer to FIG. 1A) toward the photosensitive drum 21 can pass is formed next to the protruding portion 37. The protruding portion 37 is hollow inside and has the replenishing port 32*a* formed on an upper surface thereof. The replenishing port 32*a* is configured to be connectable to the toner pack 40.

As described above, since the protruding portion 37 on which the replenishing port 32*a* is formed is provided on one end side in the longitudinal direction of the developing container 32, a laser passage space through which the laser L emitted from the scanner unit 11 can pass is secured, and thus the image forming apparatus 1 can be downsized.

The toner pack 40 includes a first shutter member 41 that is rotatable and opens and closes a discharge port of the toner pack 40, and a plurality of protrusions 42 formed to correspond to a plurality of groove portions 32*b* formed in the replenishing port 32*a*. In a case where a user replenishes the developing container 32 with the toner, the user attaches the toner pack 40 to the replenishing port 32*a* of the developing container 32. The image forming apparatus 1 is configured so that the toner pack 40 can be attached to the replenishing port 32*a* in a state in which at least part of the toner pack 40 is exposed to the outside of the image forming apparatus 1. If the toner pack 40 is rotated 180 degrees in this state, the first shutter member 41 of the toner pack 40 comes in contact with a second shutter member 38 of the replenishing port 32*a*. As a result, the first shutter member 41 of the toner pack 40 rotates about a shutter rotation axis 38*a* together with the second shutter member 38 of the replenishing port 32*a*. Then, the toner can be replenished through an inlet of the developing container 32 and a replenishing port of the toner pack 40. The first shutter member 41 rotates with respect to a main body of the toner pack 40. Accordingly, the toner stored in the toner pack 40 leaks down from the toner pack 40, and the leaked toner enters the hollow protruding portion 37 through the replenishing port 32*a*.

The protruding portion 37 has an inclined plane 37*a* at a position facing an opening of the replenishing port 32*a*, and the inclined plane 37*a* is inclined downward toward the storage chamber 36. Thus, the toner replenished through the replenishing port 32*a* is guided by the inclined plane 37*a* to the storage chamber 36. The stirring member 34 conveys the toner in a conveyance direction orthogonal to the longitudinal direction of the developing container 32.

In other words, the toner replenished through the replenishing port 32*a* arranged on an upstream side in the conveyance direction of the stirring member 34 is conveyed to a downstream side in the conveyance direction while being leveled off in the longitudinal direction by stirring by the stirring member 34. Accordingly, the toner is spread over the entire length of the developing container 32 and can be appropriately conveyed toward the developing roller 31 and the supply roller 33 by the stirring member 34.

Figure 8C:
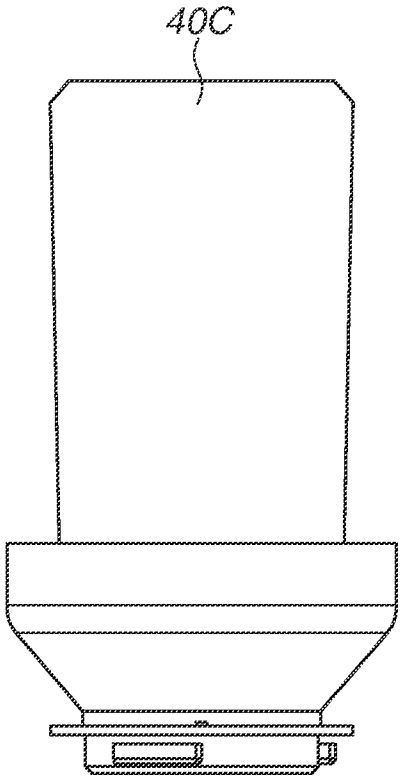
FIG. 8C is a front view of a toner pack according to a second modification.
Figure 8B:
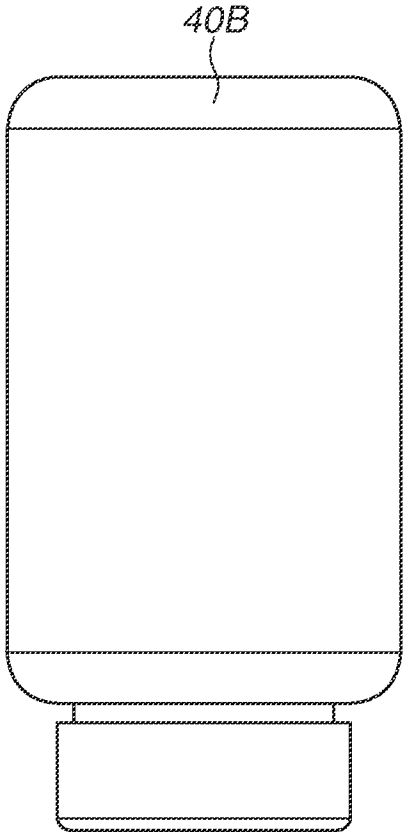
FIG. 8B is a front view of a toner pack according to a first modification.
Figure 8A:
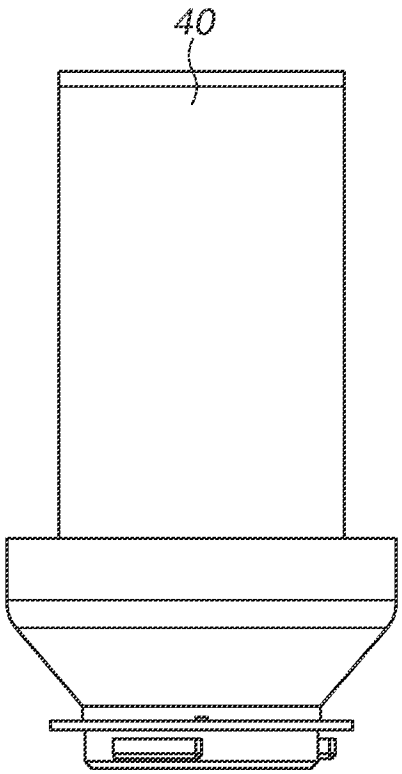
FIG. 8A is a front view of the toner pack according to the first exemplary embodiment.

In the present exemplary embodiment, the toner pack 40 is configured to be a plastic bag member which is easily deformable, as illustrated in FIG. 8A, but is not limited thereto. For example, the toner pack may be configured to be a bottle container 40B having an approximately conical shape (a first modification) as illustrated in FIG. 8B, or a paper-made container 40C (a second modification) as illustrated in FIG. 8C. In any case, the toner pack may be made of any material and into any shape. As a method for discharging the toner from the toner pack, in the case of the toner pack 40 and the paper-made container 40C, it is suitable for a user to squeeze the toner pack with fingers as illustrated in FIG. 7, and in the case of the bottle container 40B, it is suitable for the user to tap and shake the container so that the toner leaks down.

[Posture of Process Unit]

Figure 9:
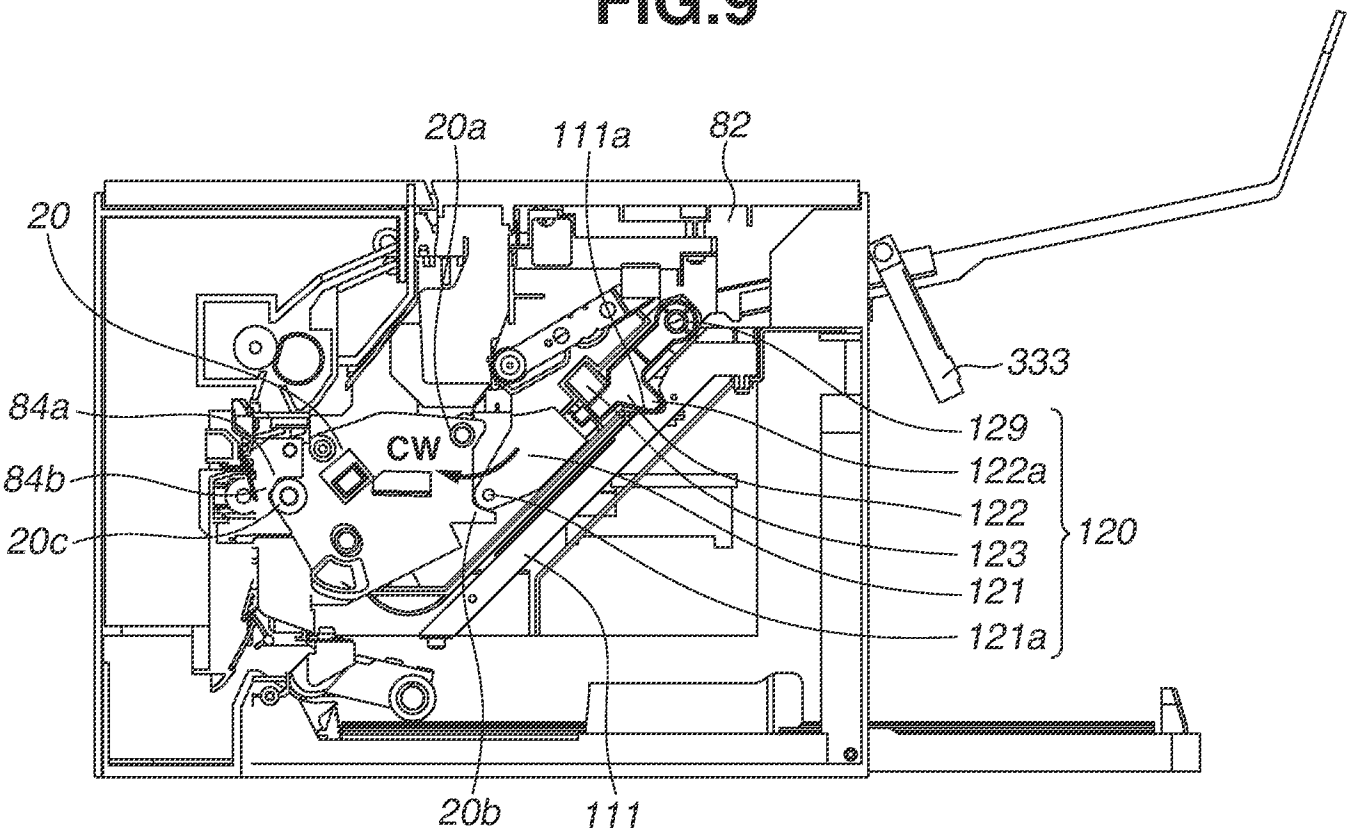
FIG. 9 is a cross-sectional view of the image forming apparatus in which the process unit is in a first posture.
Figure 10:
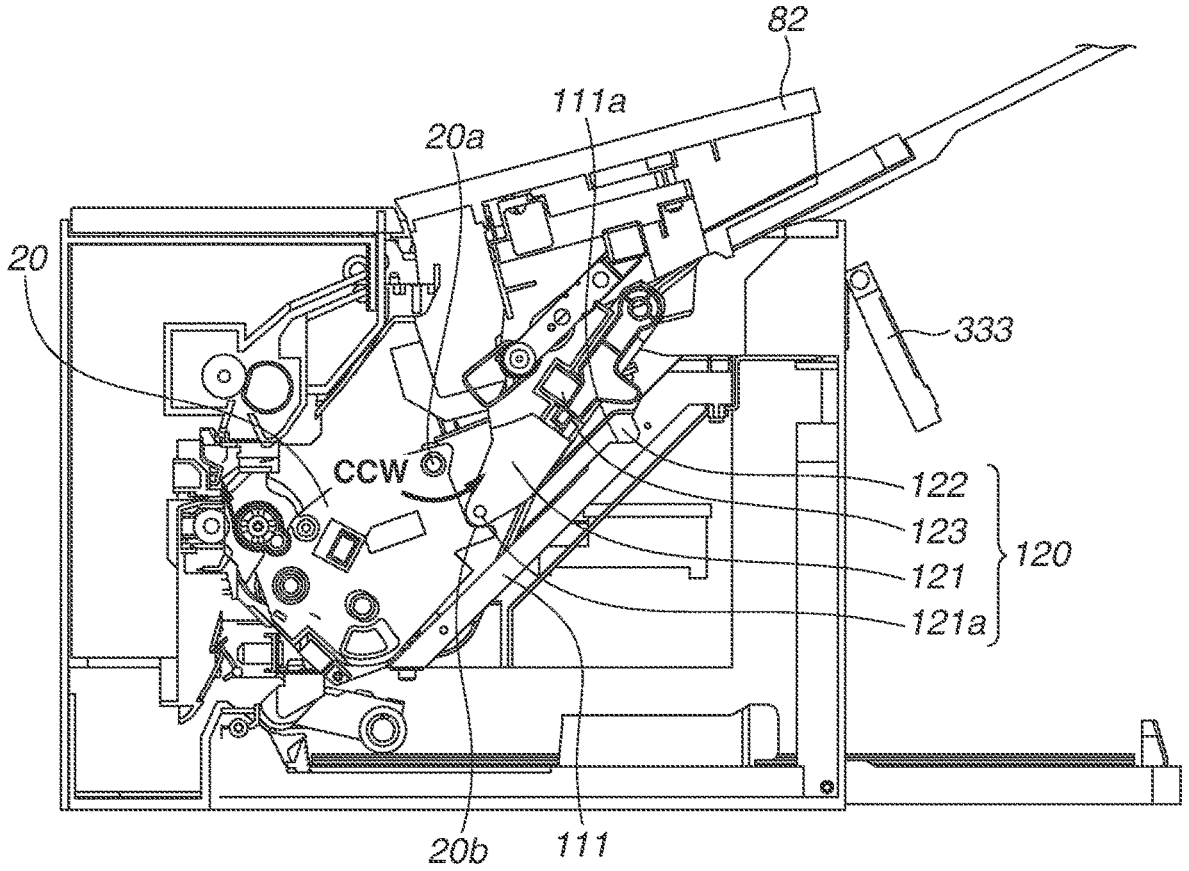
FIG. 10 is a cross-sectional view of the image forming apparatus between states in FIG. 9 and FIG. 11.
Figure 11:
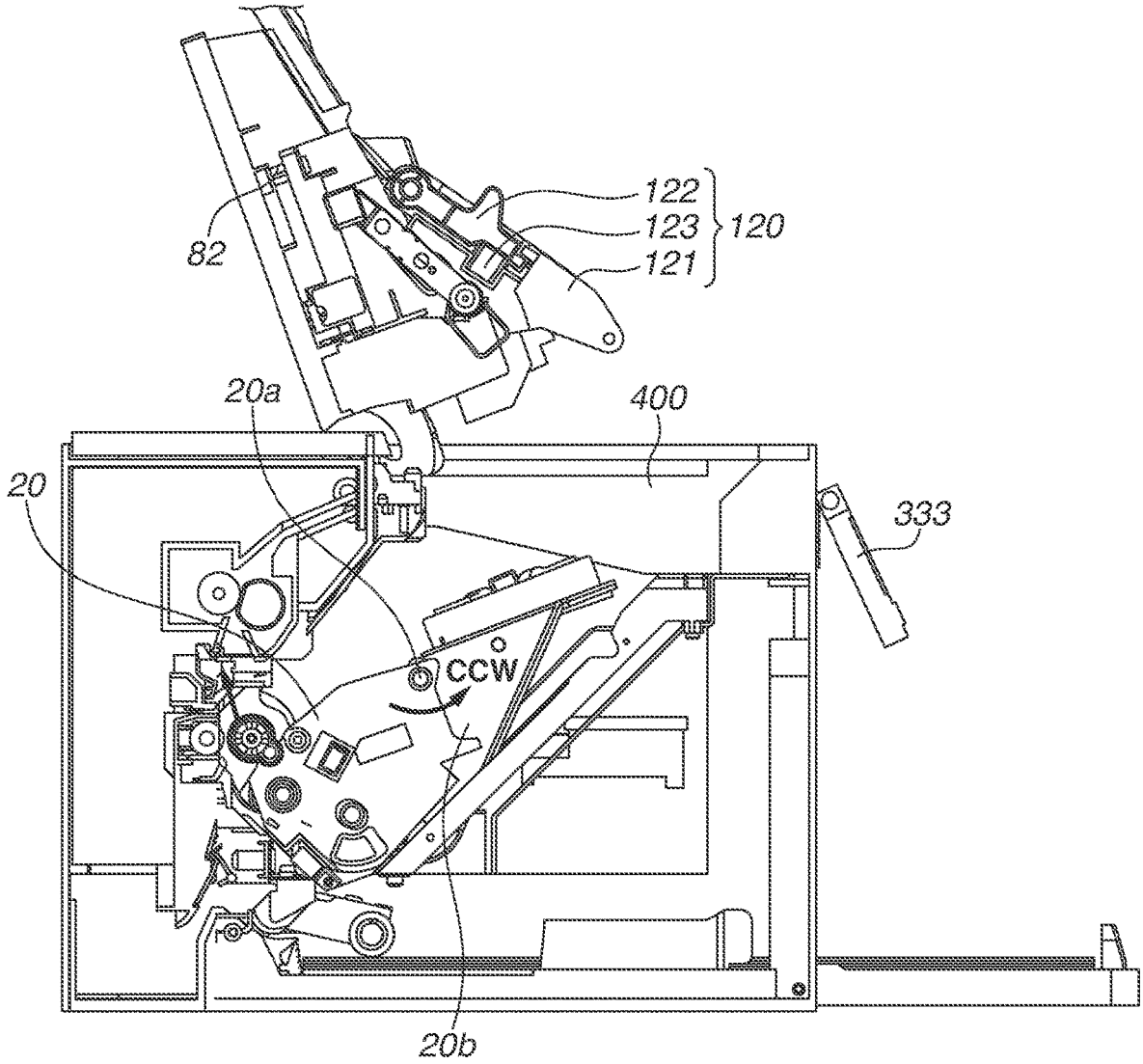
FIG. 11 is a cross-sectional view of the image forming apparatus in which the process unit is in a second posture.
Figure 13:
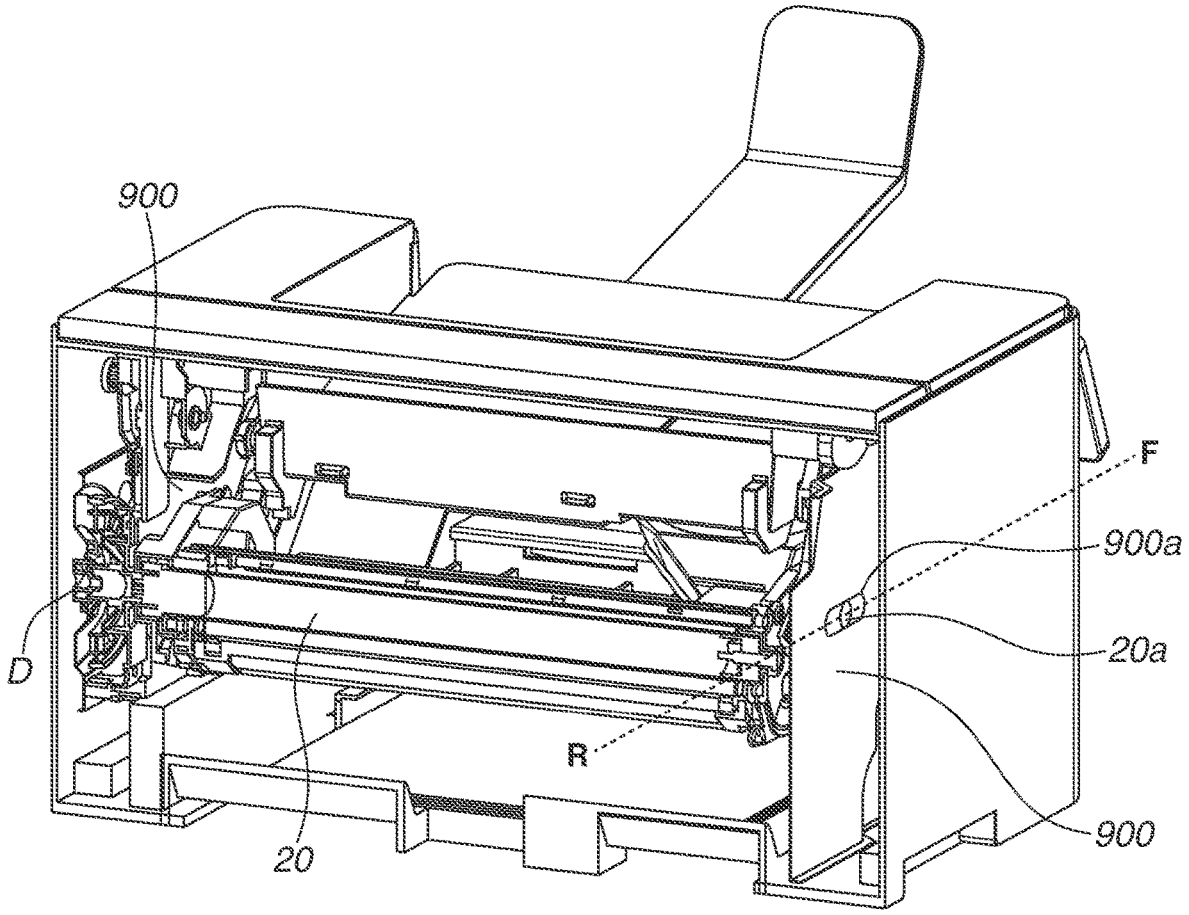
FIG. 13 illustrates the image forming apparatus viewed from a rear surface side.

A posture of the process unit 20 in the image forming apparatus 1 is described. In the image forming apparatus 1, the process unit 20 according to the present exemplary embodiment can take a first posture at which an image can be formed and a second posture for handling a jam occurred inside the image forming apparatus 1. FIG. 9 is a schematic cross-sectional view of the image forming apparatus 1 in which the process unit 20 takes the first posture. FIG. 11 is a schematic cross-sectional view of the image forming apparatus 1 in which the top cover 82 is in an open position and the process unit 20 takes the second posture. FIG. 10 is a schematic cross-sectional view of the image forming apparatus 1 at a timing between states in FIG. 9 and FIG. 11. FIG. 13 is a perspective view of the image forming apparatus 1 viewed from the side of the rear surface R in which the rear surface of the image forming apparatus 1 is cut away in order to make the structure of the image forming apparatus 1 easy to understand.

As illustrated in FIG. 13, the process unit 20 includes two side plates 900 facing each other as a frame of the image forming apparatus 1, and the process unit 20 is arranged between the two side plates 900. As illustrated in FIGS. 5A and 5B, the process unit 20 includes rotating shafts 20*a* extending in the rotation axis direction of the photosensitive drum 21 at both end portions on the rotation axis of the photosensitive drum 21. As illustrated in FIG. 13, the rotating shafts 20*a* at the both end portions of the process unit 20 are rotatably supported by long holes 900*a* respectively provided in the two side plates 900. The long holes 900*a* are holes long in the direction from the front surface F toward the rear surface R (a horizontal direction). The process unit 20 is supported by the two side plates 900 to be movable in the direction from the front surface F toward the rear surface R and a rotation direction centered on each of the rotating shafts 20*a*.

FIG. 9 illustrates the image forming apparatus 1 in a state in which an image can be formed. The process unit 20 takes the first posture, and the photosensitive drum 21 and the transfer roller 12 come into contact with each other and form a transfer nip portion N (FIG. 1A). The first posture of the process unit 20 is maintained in such a manner that the process unit 20 is pressed by a press unit 120 attached to the top cover 82. The press unit 120 includes a contact member 121, a press member 122, and an elastic member 123, and the elastic member 123 is arranged between the contact member 121 and the press member 122. The press member 122 and the contact member 121 are supported by the top cover 82 to be rotatable about a rotation center 129. The image forming apparatus 1 is also provided with a guide member 111 including a recessed portion 111*a*. The top cover 82 is in a closed position in which the opening portion 400 is closed, a protruding portion 122*a* of the press member 122 in the press unit 120 comes into contact with the recessed portion 111*a* of the guide member 111, and a contacting portion 121*a* of the contact member 121 comes into contact with a contacted portion 20*b* of the process unit 20. At that time, the contact member 121 presses the contacted portion 20*b* of the process unit 20 by an elastic force generated by the elastic member 123 being sandwiched and compressed between the contact member 121 and the press member 122. The process unit 20 receives a pressing force from the contact member 121 and thus receives a clockwise (CW) rotational force in FIG. 9 about the rotating shaft 20*a*. Further, the process unit 20 also receives a force in the direction from the front surface to the rear surface of the image forming apparatus 1. As a result, a cylinder boss 20*c* as a positioned portion provided coaxially with the photosensitive drum 21 comes into contact with positioning surfaces 84*a* and 84*b* as positioning portions provided in the image forming apparatus 1. As illustrated in FIG. 13, rotation of the process unit 20 about the cylinder boss 20*c* is regulated by the rotating shaft 20*a* engaging with the long hole 900*a*.

FIG. 11 illustrates a state in which the top cover 82 is in the open position, the process unit 20 is in the second posture, and the photosensitive drum 21 and the transfer roller 12 are separated from each other. In this state, a user can access a conveyance path through which the recording material passes when the recording material is conveyed in the transfer nip portion N. For example, in a case where the recording material is jammed due to a paper jam or the like in the conveyance path through which the recording material fed by the pickup roller 65 passes, the user needs to open the top cover 82 to perform a jam clearance operation. As illustrated in FIGS. 10 and 11, if the top cover 82 is opened, the press unit 120 moves together with the top cover 82. As a result, as illustrated in FIG. 11, the pressing force to the contacted portion 20*b* of the process unit 20 is released, and the process unit 20 rotates counterclockwise (CCW) about the rotating shaft 20*a* by its own weight. Subsequently, when a bottom surface of the process unit 20 comes into contact with the guide member 111, the rotation of the process unit 20 is regulated, and the process unit 20 is placed in the second posture.

Figure 12:
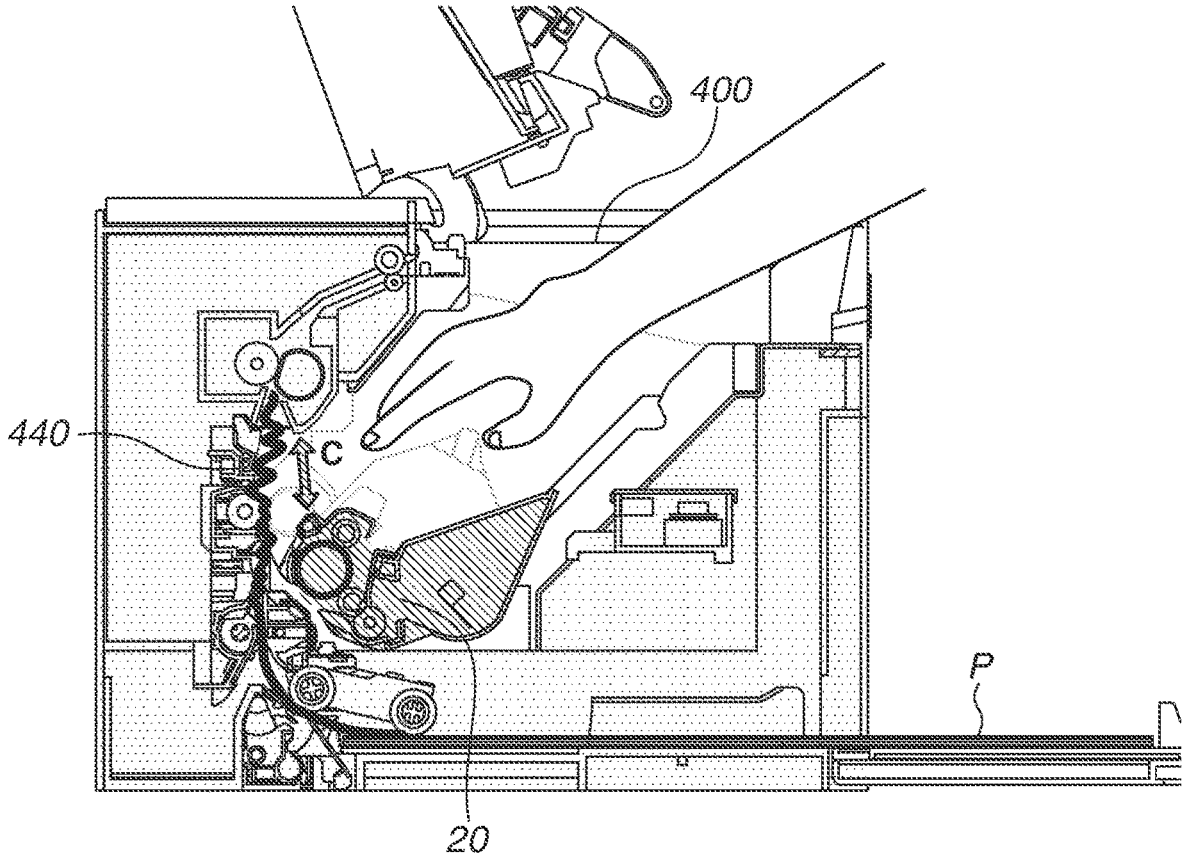
FIG. 12 illustrates a user access to a conveyance unit of the image forming apparatus in which the process unit is in the second posture.

As described above, if the process unit 20 is shifted from the first posture to the second posture, a void C is formed above the process unit 20 (FIG. 12). The user can access a conveyance path 400 via the void C and perform the jam clearance operation. The conveyance path 400 is a conveyance path through which the recording material conveyed in the transfer nip portion N passes in a case where the process unit 20 is in the first posture, forms the transfer nip portion N, and can form an image.

In the configuration according to the present exemplary embodiment, the jam clearance operation of the recording material can be performed by accessing the conveyance path of the recording material without taking the process unit 20 out of the image forming apparatus 1. As described above, in the configuration according to the present exemplary embodiment, replenishment is performed by the user attaching the toner pack 40 to the replenishing port 32*a* in a case where the process unit 20 is in the first posture, so that it is not necessary to take out the process unit 20 from the image forming apparatus 1 at the time of toner replenishment. Further, the configuration according to the present exemplary embodiment is the cleaner-less configuration that does not include the collection container for used toner. Thus, it is not necessary to take out the process unit 20 from the image forming apparatus 1 to replace the collection container. In other words, in the image forming apparatus 1 according to the present exemplary embodiment, since the user does not need to take out the process unit 20 from the image forming apparatus 1, usability can be greatly improved.

Figure 14A:
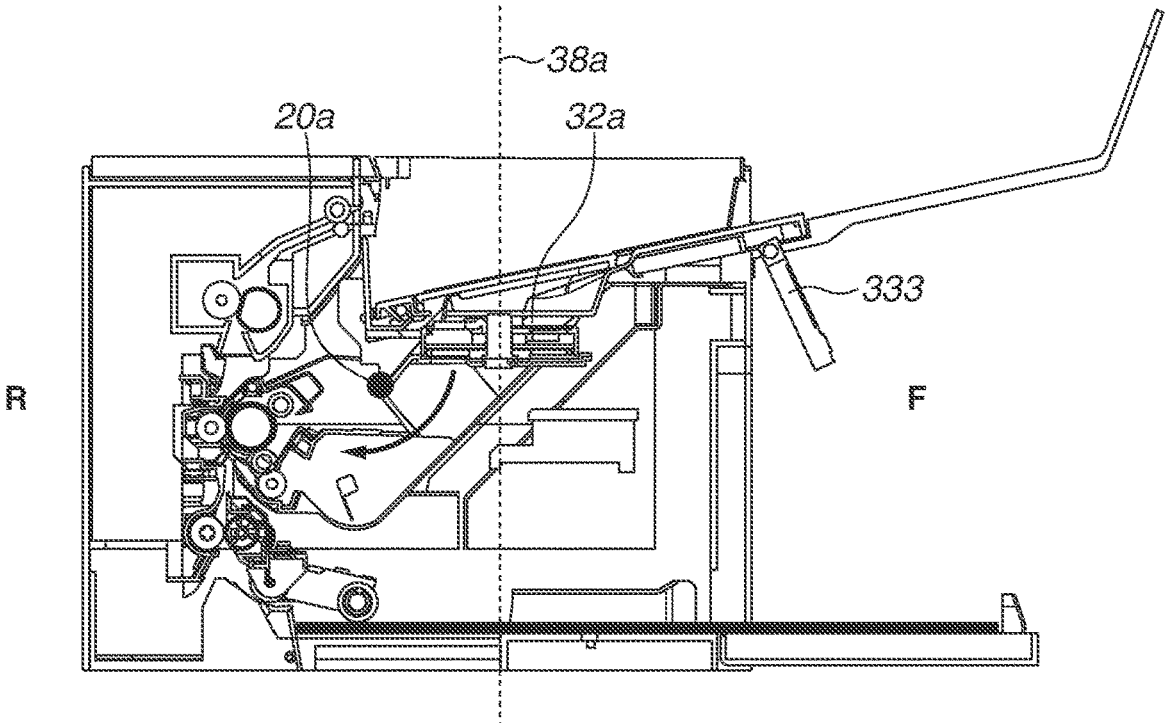
FIG. 14A is a schematic cross-sectional view illustrating a posture of a replenishing port of a developing container in a case where the process unit is in the first posture.
Figure 14B:
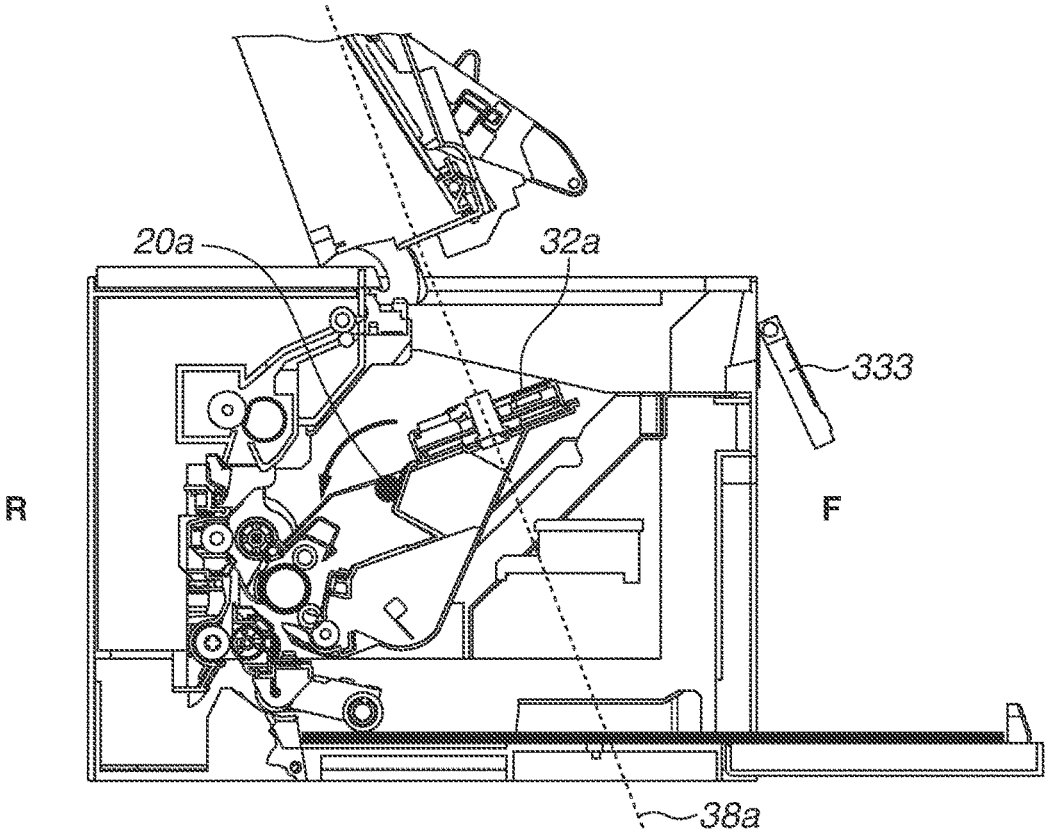
FIG. 14B is a schematic cross-sectional view illustrating the posture of the replenishing port of the developing container in a case where the process unit is in the second posture.

An orientation of the replenishing port 32*a* of the process unit 20 changes with the rotation of the process unit 20. FIGS. 14A and 14B illustrate orientations of the replenishing port 32*a* of the process unit 20 in the first posture and in the second posture, respectively. In a case where the process unit 20 takes the first posture illustrated in FIG. 14A, the shutter rotation axis 38*a* of the second shutter member 38 of the replenishing port 32*a* extends in a vertical direction. Thus, the user can easily attach the toner pack 40 to the replenishing port 32*a* from the side of the front surface F of the image forming apparatus 1. In a case where the process unit 20 takes the second posture illustrated in FIG. 14B, the shutter rotation axis 38*a* of the second shutter member 38 of the replenishing port 32*a* is tilted so that the shutter rotation axis 38*a* extends upward in the direction from the front surface F toward the rear surface R of the image forming apparatus 1. In other words, a direction in which the process unit 20 rotates about the rotating shaft 20*a* at the time when the process unit 20 is shifted from the first posture to the second posture is a direction in which the replenishing port 32*a* moves away when the image forming apparatus 1 is viewed from the side of the front surface F. This direction is also a direction in which the replenishing port 32*a* faces the side of the rear surface R. Thus, in a case where the process unit 20 is in the second posture, the replenishing port 32*a* is in an orientation that is difficult to be seen from the side of the front surface F of the image forming apparatus 1 and in an orientation in which the toner pack 40 is difficult to be attached. Thus, it is possible to prevent the toner pack 40 from being accidentally attached to the replenishing port 32*a* for replenishment.

Alternatively, in the first posture, the replenishing port 32*a* may be provided in a tilted orientation in which the shutter rotation axis 38*a* extends downward in the direction from the front surface F toward the rear surface R of the image forming apparatus 1. In this configuration, in a case where the process unit 20 is in the first posture, the replenishing port 32*a* faces the side of the front surface F, and thus attachability of the toner pack 40 to the replenishing port 32*a* is further improved.

As described above, according to the present exemplary embodiment, the user does not need to take out the process unit from a main body of the apparatus for performing the jam clearance operation, thereby usability can be improved.

Further, at the time of the jam clearance operation, the process unit rotates in the direction in which the replenishing port is difficult to be seen from the side of the front surface of the image forming apparatus and the toner pack is difficult to be attached. Therefore, it is possible to prevent the toner pack from being accidentally attached for replenishment in the jam clearance operation.

In the present exemplary embodiment, the image forming apparatus of the toner replenishing type is described, but the present invention can also be applied to an image forming apparatus that includes a process cartridge that can be attached to and detached from a frame.

Second Exemplary Embodiment

A second exemplary embodiment of the present invention is described. A configuration similar to that of the first exemplary embodiment is omitted from illustration or denoted by the same reference numeral in the drawings.

Figure 16A:
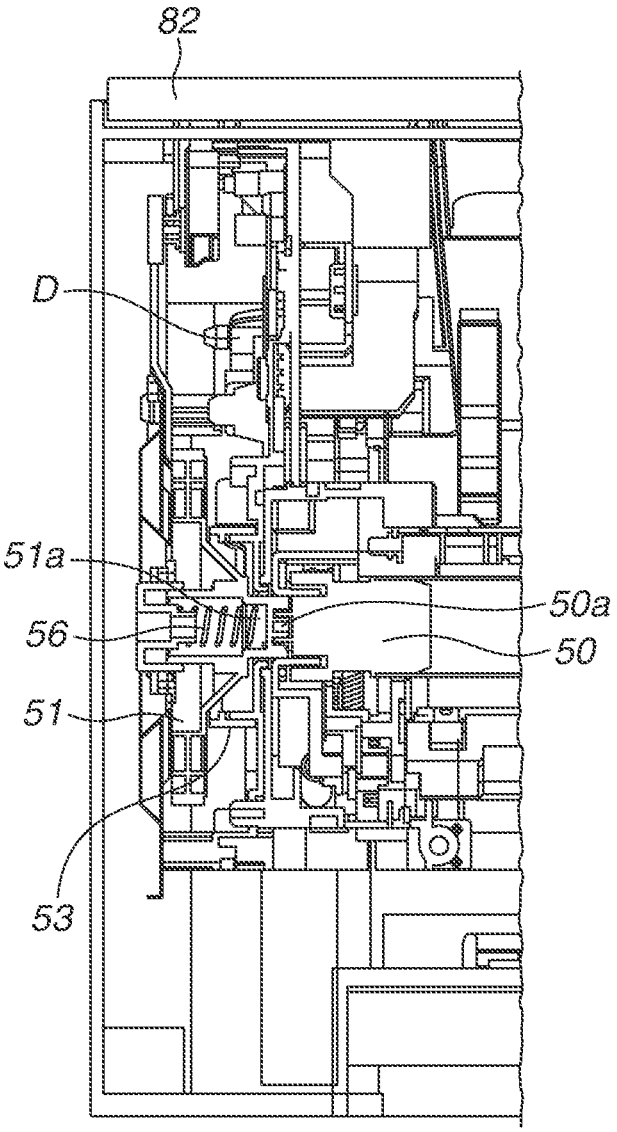
FIG. 16A is a detailed view of the drive unit of the image forming apparatus according to the first exemplary embodiment in a case where the top cover is in the closed position.
Figure 16B:
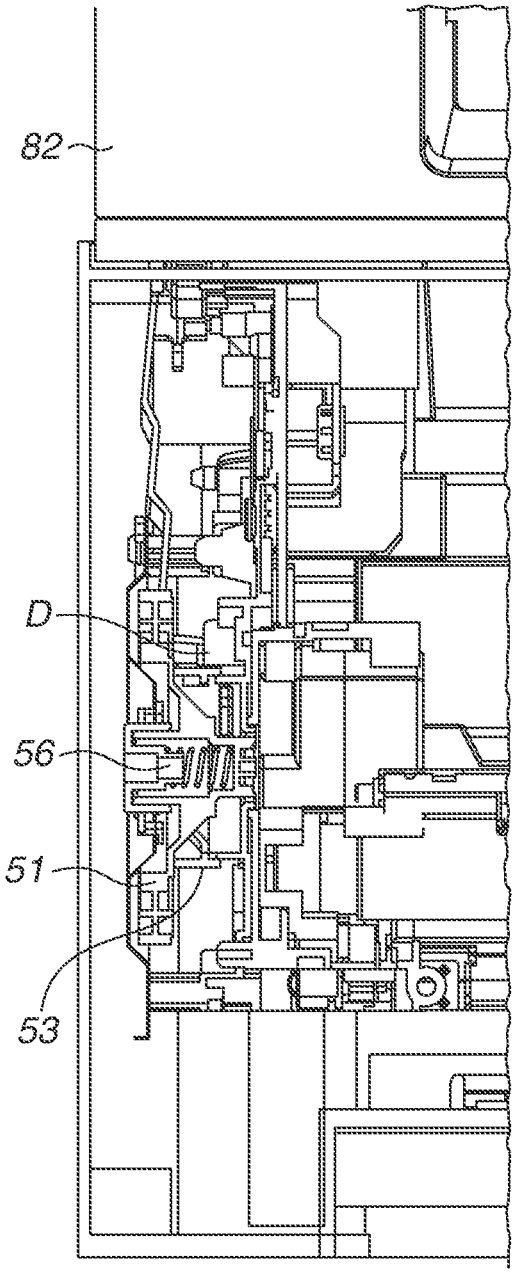
FIG. 16B is a detailed view of the drive unit of the image forming apparatus according to the first exemplary embodiment in a case where the top cover is in the open position.

FIGS. 16A and 16B are diagrams each illustrating in detail a drive unit D of the image forming apparatus 1 illustrated in FIG. 13. The drive unit D includes a photosensitive drum gear 50 (a first drive transmission member) that is provided coaxially with the photosensitive drum 21 and rotates together with the photosensitive drum 21, and a drum drive gear 51 (a second drive transmission member) that transmits a drive force for driving the photosensitive drum 21. A driving coupling 51*a* of the drum drive gear 51 and a driven coupling 50*a* of the photosensitive drum gear 50 engage with each other so that the drive force is transmitted from the drum drive gear 51 to the photosensitive drum gear 50, and the photosensitive drum 21 rotates.

Figure 15A:
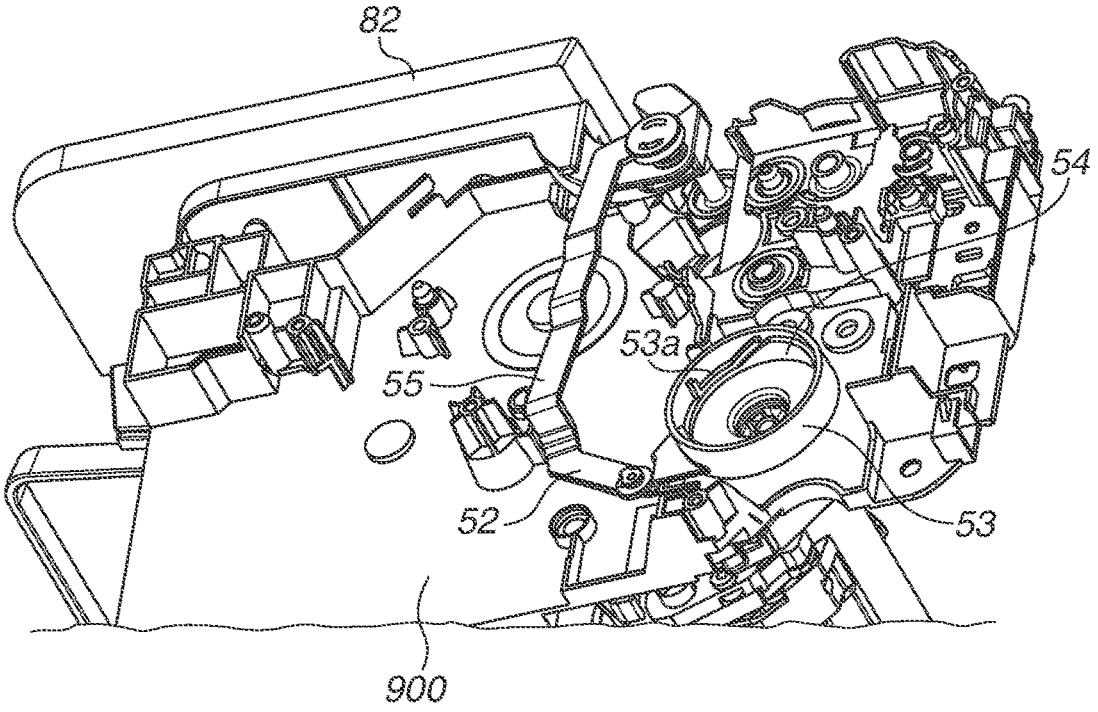
FIG. 15A is a perspective view of a drive unit of the image forming apparatus according to the first exemplary embodiment in a case where a top cover is in a closed position.
Figure 15B:
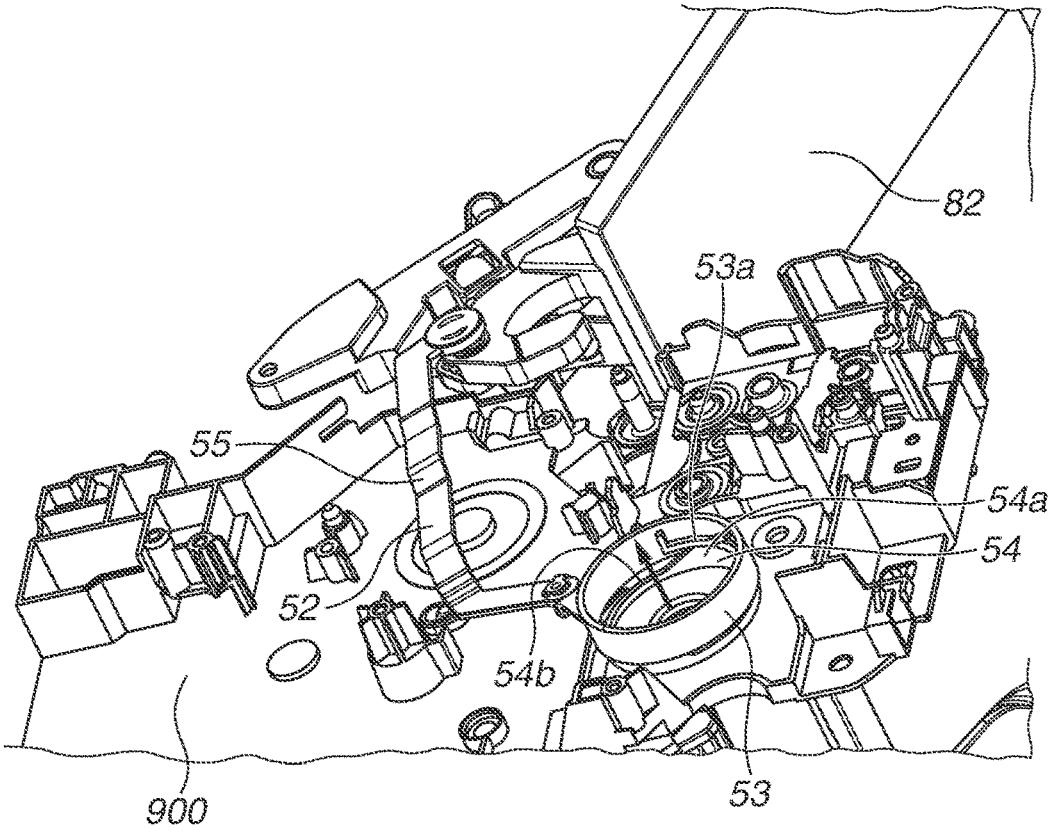
FIG. 15B is a perspective view of the drive unit of the image forming apparatus according to the first exemplary embodiment in a case where the top cover is in an open position.

FIGS. 15A and 15B are perspective views illustrating the top cover 82 in the closed position and in the open position, respectively, in which an exterior cover of the drive unit D in the image forming apparatus 1 illustrated in FIG. 13 is removed. As illustrated in FIG. 15A, a rotary cam mechanism 52 includes a rotary cam 53, a frame cam portion 54, a link 55, and the top cover 82. The rotary cam 53 is rotatably supported by one of the side plates 900, and a cam portion 53*a* of the rotary cam 53 comes into contact with the frame cam portion 54. The frame cam portion 54 includes a protruding portion 54*a* and a recessed portion 54*b* that are aligned in a rotation direction of the cam portion 53*a*. The rotary cam 53 is rotatably connected to the link 55, and the link 55 is rotatably connected to the top cover 82. As illustrated in FIG. 15B, if the top cover 82 is opened, the link 55 is pulled, and the rotary cam 53 rotates with respect to the side plate 900. As the rotary cam 53 rotates, the cam portion 53*a* of the rotary cam 53 comes into contact with the protruding portion 54*a* of the frame cam portion 54, and the rotary cam 53 moves outward in the rotation axis direction of the photosensitive drum 21 (in an arrow direction in FIG. 15B).

By the rotary cam 53 moving outward, the drum drive gear 51 arranged on an outer side of the rotary cam 53 in the rotation axis direction of the photosensitive drum 21 also moves in the rotation axis direction of the photosensitive drum 21 together with the rotary cam 53. Accordingly, coupling engagement between the driving coupling 51*a* of the drum drive gear 51 and the driven coupling 50*a* of the photosensitive drum gear 50 is released. The drum drive gear 51 is urged inward by an urging member 56 in the rotation axis direction of the photosensitive drum 21. Thus, in a case where the drum drive gear 51 moves outward together with the rotary cam 53, the drum drive gear 51 moves against an urging force of the urging member 56. Conversely, as illustrated in FIG. 15A, if the link 55 moves in conjunction with a closing operation of the top cover 82 and the cam portion 53*a* of the rotary cam 53 rotates to a position facing the recessed portion 54*b* of the frame cam portion 54, the rotary cam 53 becomes movable inward. As a result, the drum drive gear 51 moves inward in the rotation axis direction of the photosensitive drum 21 together with the rotary cam 53 by the urging force of the urging member 56, and the driving coupling 51*a* of the drum drive gear 51 and the driven coupling 50*a* of the photosensitive drum gear 50 engage with each other.

Figure 17A:
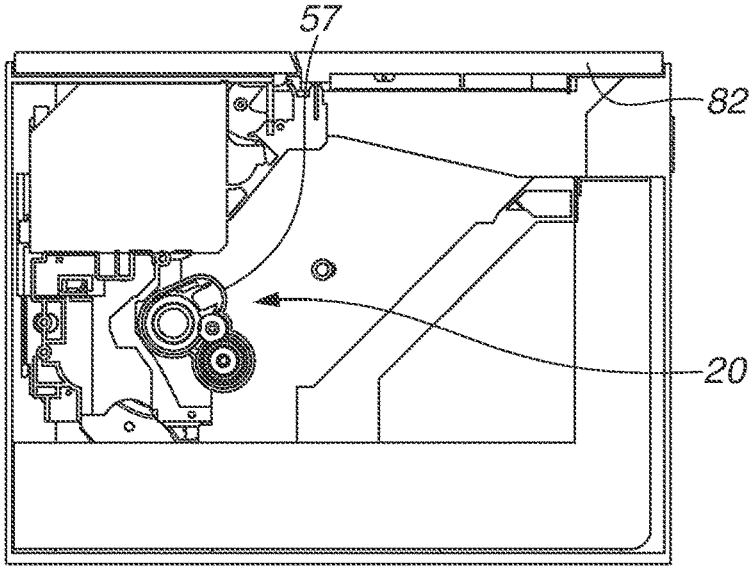
FIG. 17A illustrates a relative positional relationship between a side cover of the process unit and a drum drive gear in a case where the top cover is in the closed position in the image forming apparatus according to the first exemplary embodiment.
Figure 17B:
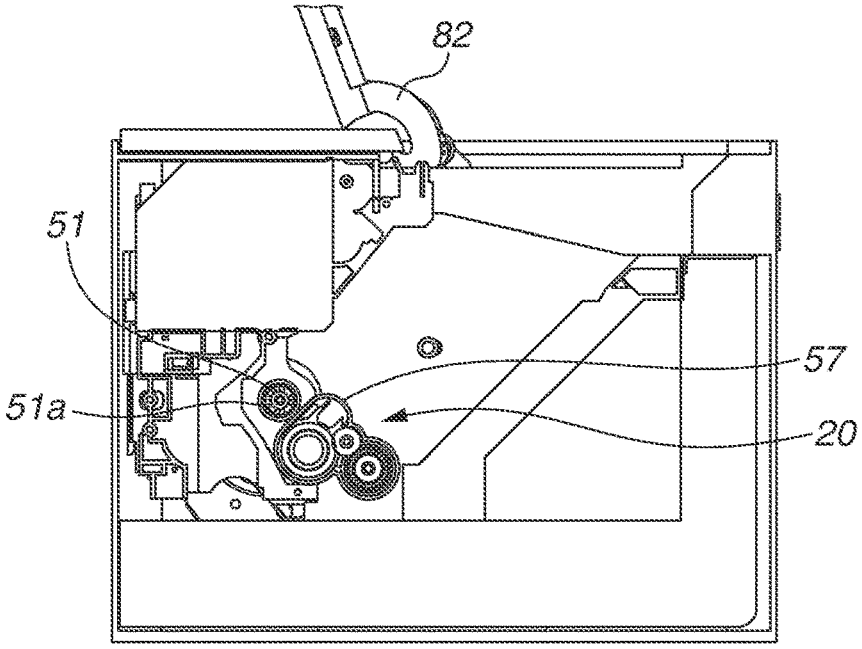
FIG. 17B illustrates the relative positional relationship between the side cover of the process unit and the drum drive gear in a case where the top cover is in the open position in the image forming apparatus according to the first exemplary embodiment.
Figure 17C:
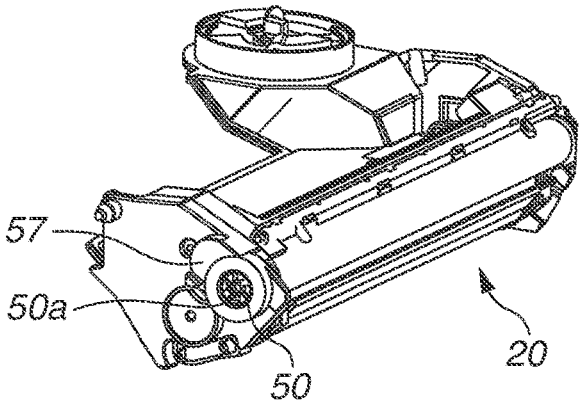
FIG. 17C is a perspective view of the process unit that includes the side cover according to the first exemplary embodiment.

Next, FIG. 17A illustrates a relative positional relationship between a side cover 57 of the process unit 20 and the drum drive gear 51 in a case where the top cover 82 is in the closed position in the image forming apparatus 1 according to the first exemplary embodiment. FIG. 17B illustrates a relative positional relationship between the side cover 57 of the process unit 20 and the drum drive gear 51 in a case where the top cover 82 is in the open position. FIG. 17C is a perspective view of the process unit 20.

As illustrated in FIG. 17C, the side cover 57 that exposes the driven coupling 50*a* while covering the photosensitive drum gear 50 is provided at an end portion of the process unit 20 on a side on which the photosensitive drum gear 50 and the driven coupling 50*a* are located. As illustrated in FIG. 17B, in a case where the top cover 82 is in the open position and the process unit 20 is in the second posture, the side cover 57 of the process unit 20 does not overlap the drum drive gear 51 when being viewed in the rotation axis direction of the photosensitive drum 21. In a case where the process unit 20 is shifted to the first posture from this state by moving the top cover 82 toward the closed position, there is a following issue. If the drum drive gear 51 moves inward (in a direction approaching the process unit 20) before overlapping the side cover 57 of the process unit 20, the side cover 57 interferes with the driving coupling 51*a* of the drum drive gear 51 and cannot rotate. Thus, it is necessary to configure the drum drive gear 51 to move inward after the process unit 20 rotates and the side cover 57 overlaps the drum drive gear 51. Therefore, in a case where the top cover 82 is moved from the open position to the closed position, it is necessary to move the drum drive gear 51 inward in a short time at an end of a profile of the rotary cam 53. Conversely, in a case where the top cover 82 is moved from the closed position to the open position, it is necessary to retract the drum drive gear 51 outward in a short time immediately after movement of the top cover 82 is started. Thus, the profiles of the frame cam portion 54 and the rotary cam 53 are steepened to move the drum drive gear 51 in the rotation axis direction of the photosensitive drum 21 in a short time, and an operation load of the top cover 82 may be increased.

Figure 18A:
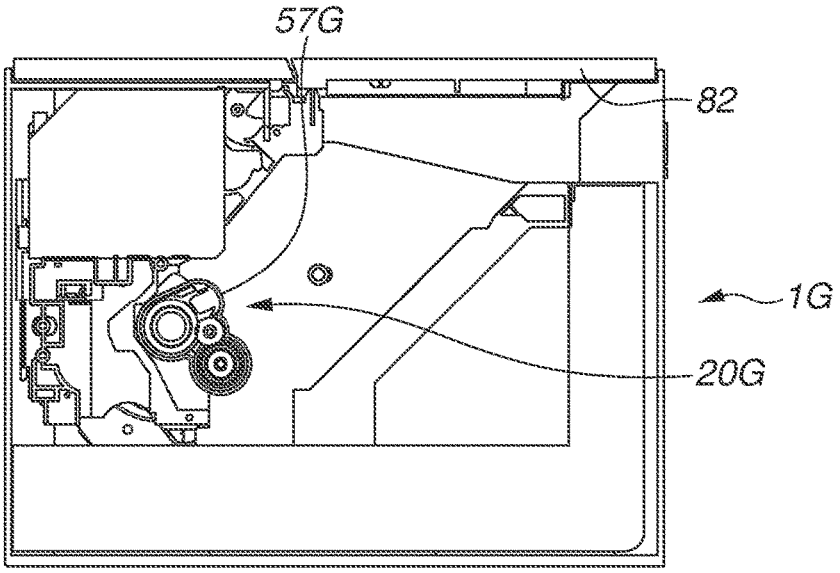
FIG. 18A illustrates a relative positional relationship between a side cover of a process unit and a drum drive gear in a case where a top cover is in a closed position in an image forming apparatus according to a second exemplary embodiment.
Figure 18B:
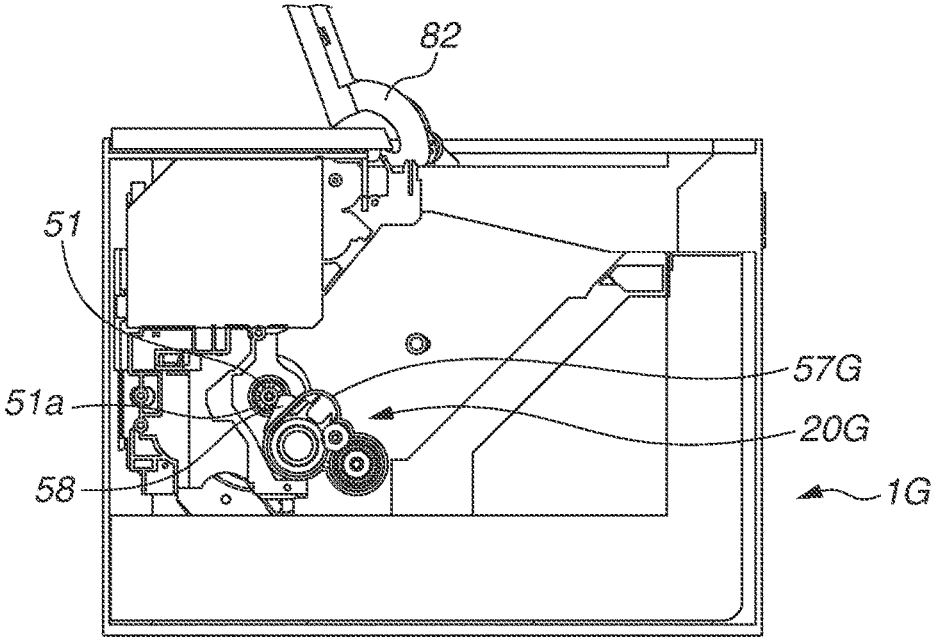
FIG. 18B illustrates the relative positional relationship between the side cover of the process unit and the drum drive gear in a case where the top cover is in an open position in the image forming apparatus according to the second exemplary embodiment.
Figure 18C:
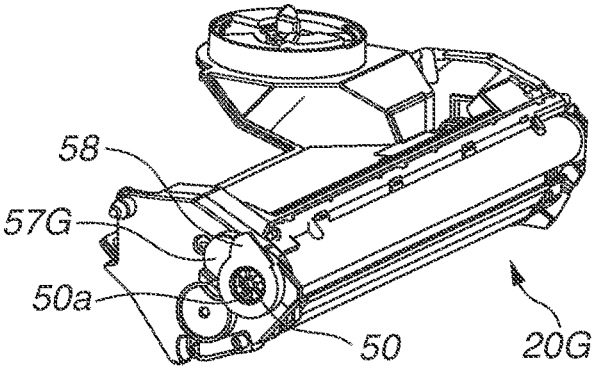
FIG. 18C is a perspective view of the process unit that includes the side cover according to the second exemplary embodiment.

Next, a configuration of an image forming apparatus 1G according to the second exemplary embodiment is described. FIG. 18A illustrates a relative positional relationship between a side cover 57G of a process unit 20G and the drum drive gear 51 in a case where the top cover 82 is in the closed position. FIG. 18B illustrates a relative positional relationship between the side cover 57G of the process unit 20G and the drum drive gear 51 in a case where the top cover 82 is in the open position. FIG. 18C is a perspective view of the process unit 20G A difference from the first exemplary embodiment is that the side cover 57G of the process unit 20G has a pressing rib 58 (a protruding shape). As illustrated in FIG. 18B, in a case where the process unit 20G is in the second posture, the pressing rib 58 of the side cover 57G of the process unit 20G overlaps a drum drive gear 51G when viewed in the rotation axis direction of the photosensitive drum 21. If the top cover 82 is moved from this state toward the closed position, the process unit 20G is shifted to the first posture, but the drum drive gear 51 can move only to a position at which the drum drive gear 51 abuts on the pressing rib 58 even if the drum drive gear 51 tries to move inward in the rotation axis direction of the photosensitive drum 21. If the process unit 20G rotates to a position at which the driven coupling 50*a* of the photosensitive drum gear 50 can engage with the driving coupling 51*a* of the drum drive gear 51, the drum drive gear 51 urged by the urging member 56 moves inward. As a result, the driven coupling 50*a* of the photosensitive drum gear 50 and the driving coupling 51*a* of the drum drive gear 51 engage with each other.

In the configuration according to the second exemplary embodiment, the profiles of the frame cam portion 54 and the rotary cam 53 can be gently inclined, so that an operation force of the top cover 82 does not change significantly. Accordingly, operability of the top cover 82 can be improved.

The present invention is not limited to the above-described exemplary embodiments, and various modifications can be made without departing from the spirit and the scope of the present invention. Therefore, the following claims are attached to publicize the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus to form a toner image on a recording material from toner contained in a toner container detachably attached to the image forming apparatus, the image forming apparatus comprising:

a process unit including a photosensitive drum configured to carry a toner image and to rotate about a first rotation axis, a developing roller configured to carry and supply toner to the photosensitive drum, and a toner storage unit configured to store the toner to be carried by the developing roller, wherein the toner storage unit is provided with a replenishing port to which the toner container is detachably attached and through which the toner in the toner storage unit is replenished from the toner in the toner container;

a transfer member configured to come into contact with the photosensitive drum and to form a transfer nip portion together with the photosensitive drum, wherein the transfer nip portion is a portion where the toner image carried by the photosensitive drum is transferred to the recording material while conveying the recording material;

a conveyance path configured to allow the recording material conveyed by the transfer nip portion to pass through the conveyance path;

a frame including an opening portion and configured to support the process unit so that the process unit is rotatable, relative to the frame, about a second rotation axis extending in a direction of the first rotation axis; and an opening and closing member configured to be movable between a closed position at which the opening and closing member closes the opening portion and an open position at which the opening and closing member opens the opening portion, wherein, in a case where the opening and closing member is in the open position, the opening and closing member allows access to the conveyance path through the opening portion of the frame from an outside of the image forming apparatus, and wherein the process unit is configured to rotate about the second rotation axis between a first position at which the photosensitive drum comes into contact with the transfer member to form the transfer nip portion and a second position at which the photosensitive drum is separated from the transfer member.

2. The image forming apparatus according to claim 1, wherein, in a case where the opening and closing member is in the closed position, the process unit is in the first position, and in the case where the opening and closing member is in the open position, the process unit is in the second position.

3. The image forming apparatus according to claim 2, wherein the opening and closing member includes a press member and, in a case where the opening and closing member is moved from the open position to the closed position, the press member presses the process unit to rotate from the second position to the first position.

4. The image forming apparatus according to claim 3, wherein, in a case where the opening and closing member is moved from the closed position to the open position, a weight of the process unit causes the process unit to rotate from the first position to the second position, and then the process unit is not pressed by the press member of the opening and closing member.

5. The image forming apparatus according to claim 1, wherein the process unit is configured not to be detachable from the frame.

6. The image forming apparatus according to claim 1, further comprising a discharging roller configured to discharge the recording material in a discharging direction, wherein the opening and closing member includes an upper surface on which the recording material, discharged by the discharging roller, is to be stacked in a case where the opening and closing member is in the closed position.

7. The image forming apparatus according to claim 6, wherein the process unit is configured to rotate about the second rotation axis from the first position to the second position so that the replenishing port approaches the discharging roller.

8. The image forming apparatus according to claim 1, wherein the second rotation axis of the process unit is positioned between the photosensitive drum and the replenishing port in a direction perpendicular to the first rotation axis, and wherein, when viewed in the direction of the first rotation axis and in a case where the process unit is being rotated about the second rotation axis from the first position to the second position, the photosensitive drum is moved downward and the replenishing port is moved upward while the process unit is being rotated.

9. The image forming apparatus according to claim 1, wherein the image forming apparatus is configured so that the toner container can be attached to the replenishing port in a state in which at least part of the toner container is located on the outside of the image forming apparatus.

* * * * *